US006268890B1

(12) United States Patent
Kawahara

(10) Patent No.: US 6,268,890 B1
(45) Date of Patent: Jul. 31, 2001

(54) IMAGE DISPLAY APPARATUS WITH SELECTED COMBINATIONS OF SUBFIELDS DISPLAYED FOR A GRAY LEVEL

(75) Inventor: Isao Kawahara, Toyono-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/053,931

(22) Filed: Apr. 2, 1998

(30) Foreign Application Priority Data

| | | |
|---|---|---|
| Apr. 2, 1997 | (JP) | 9-083614 |
| May 20, 1997 | (JP) | 9-129249 |
| Jun. 19, 1997 | (JP) | 9-162258 |

(51) Int. Cl.[7] ..... H04N 9/12; H04N 5/21; H04N 9/64

(52) U.S. Cl. ..... 348/739; 348/631; 348/671; 348/715

(58) Field of Search ..... 348/739, 631, 348/671, 715, 607, 624, 625, 630; H04N 5/21, 9/12, 9/64, 5/14

(56) References Cited

FOREIGN PATENT DOCUMENTS

| | | |
|---|---|---|
| 646906 | 4/1995 | (EP) . |
| 698874 | 2/1996 | (EP) . |
| 77702 | 1/1995 | (JP) . |
| 7248743 | 9/1995 | (JP) . |
| 7261696 | 10/1995 | (JP) . |
| 7271325 | 10/1995 | (JP) . |

OTHER PUBLICATIONS

"All About Plasma Display," H. Uchiike et al., Kogyo Chosakai, Tokyo May 1, 1997, pp. 165–177.

*Primary Examiner*—Sherrie Hsia
(74) *Attorney, Agent, or Firm*—Price and Gess

(57) ABSTRACT

An image display apparatus is provided for reducing occurrences of moving image false-edges by preventing profound changes in "on"/"off" subfield distribution, and for displaying a sharp image that does not appear blurred. This is achieved by effectively dividing one TV field and by displaying a gray level of an input image signal using an "on"/"off" subfield combination, out of possible "on"/"off" subfield combinations for displaying the gray level, in which a number of subfields with large luminance weightings that are "on" is minimized.

32 Claims, 20 Drawing Sheets

FIG. 3

TIME

| DIGITAL IMAGE SIGNAL LEVEL | | | 3 | 4 | 5 | 6 | 7 | 8 | 9 | 10 | 11 | 12 | SUBFIELD SF NUMBER WEIGHTING |
|---|---|---|---|---|---|---|---|---|---|---|---|---|---|
| | | | 4 | 8 | 12 | 20 | 24 | 28 | 32 | 36 | 40 | 48 | |
| 0 | ~ | 3 | | | | | | | | | | | |
| 4 | ~ | 7 | ● | | | | | | | | | | |
| 8 | ~ | 11 | | ● | | | | | | | | | |
| 12 | ~ | 15 | ● | ● | | | | | | | | | |
| 16 | ~ | 19 | ● | | ● | | | | | | | | |
| 20 | ~ | 23 | | ● | ● | | | | | | | | |
| 24 | ~ | 27 | ● | ● | ● | | | | | | | | |
| 28 | ~ | 31 | | ● | | ● | | | | | | | |
| 32 | ~ | 35 | ● | ● | | ● | | | | | | | |
| 36 | ~ | 39 | ● | | ● | ● | | | | | | | |
| 40 | ~ | 43 | | ● | ● | ● | | ③ | | | | | |
| 44 | ~ | 47 | ● | ● | ● | ● | | | | | | | |
| 48 | ~ | 51 | ● | ● | ● | | ● | | | | | | |
| 52 | ~ | 55 | | ● | | ● | ● | | | | | | |
| 56 | ~ | 59 | ● | ● | | ● | ● | | | | | | |
| 60 | ~ | 63 | ● | | ● | ● | ● | | | | | | |
| 64 | ~ | 67 | | ● | ● | ● | ● | | | | | | |
| 68 | ~ | 71 | ● | ● | ● | ● | ● | | | | | | |
| 72 | ~ | 75 | ● | ● | ● | ● | | ● | | | | | |
| 76 | ~ | 79 | ● | ● | ● | | ● | ● | | | | | |
| 80 | ~ | 83 | | ● | | ● | ● | ● | | | | | |
| 84 | ~ | 87 | ● | ● | | ● | ● | ● | | | | | |
| 88 | ~ | 91 | ● | | ● | ● | ● | ● | | | | | |
| 92 | ~ | 95 | | ● | ● | ● | ● | ● | | | | | |
| 96 | ~ | 99 | ● | ● | ● | ● | ● | ● | | | | | |
| 100 | ~ | 103 | ● | ● | ● | ● | ● | | ● | | | | |
| 104 | ~ | 107 | ● | ● | ● | ● | | ● | ● | | | | |
| 108 | ~ | 111 | ● | ● | ● | | ● | ● | ● | | | | |
| 112 | ~ | 115 | | ● | | ● | ● | ● | ● | | | | |
| 116 | ~ | 119 | ● | ● | | ● | ● | ● | ● | | | | |
| 120 | ~ | 123 | ● | | ● | ● | ● | ● | ● | | ① | | |
| 124 | ~ | 127 | | ● | ● | ● | ● | ● | ● | | | | |
| 128 | ~ | 131 | | ● | ● | ● | ● | ● | | ● | | | |
| 132 | ~ | 135 | | ● | ● | ● | ● | | ● | ● | | | |
| 136 | ~ | 139 | | ● | ● | ● | | ● | ● | ● | | | |
| 140 | ~ | 143 | | ● | ● | | ● | ● | ● | ● | | | |
| 144 | ~ | 147 | ● | | | ● | ● | ● | ● | ● | | | |
| 148 | ~ | 151 | | ● | | ● | ● | ● | ● | ● | | | |
| 152 | ~ | 155 | ● | ● | | ● | ● | ● | ● | ● | | | |
| 156 | ~ | 159 | ● | | ● | ● | ● | ● | ● | ● | | | |
| 160 | ~ | 163 | | ● | ● | ● | ● | ● | ● | ● | | | |
| 164 | ~ | 167 | ● | ● | ● | ● | ● | ● | ● | ● | | | |
| 168 | ~ | 171 | ● | ● | ● | ● | ● | ● | ● | | ● | | |
| 172 | ~ | 175 | ● | ● | ● | ● | ● | ● | | ● | ● | | |
| 176 | ~ | 179 | ● | ● | ● | ● | ● | | ● | ● | ● | | |
| 180 | ~ | 183 | ● | ● | ● | ● | | ● | ● | ● | ● | | |
| 184 | ~ | 187 | ● | ● | ● | | ● | ● | ● | ● | ● | | |
| 188 | ~ | 191 | | ● | | ● | ● | ● | ● | ● | ● | | |
| 192 | ~ | 195 | ● | ● | | ● | ● | ● | ● | ● | ● | | |
| 196 | ~ | 199 | ● | | ● | ● | ● | ● | ● | ● | ● | | |
| 200 | ~ | 203 | | ● | ● | ● | ● | ● | ● | ● | ● | | ② |
| 204 | ~ | 207 | ● | ● | ● | ● | ● | ● | ● | ● | ● | | |
| 208 | ~ | 211 | | ● | ● | ● | ● | ● | ● | ● | | ● | |
| 212 | ~ | 215 | | ● | ● | ● | ● | ● | ● | | ● | ● | |
| 216 | ~ | 219 | | ● | ● | ● | ● | ● | | ● | ● | ● | |
| 220 | ~ | 223 | | ● | ● | ● | ● | | ● | ● | ● | ● | |
| 224 | ~ | 227 | | ● | ● | ● | | ● | ● | ● | ● | ● | |
| 228 | ~ | 231 | | ● | ● | ● | ● | ● | ● | ● | ● | ● | |
| 232 | ~ | 235 | ● | ● | ● | | ● | ● | ● | ● | ● | ● | |
| 236 | ~ | 239 | | ● | | ● | ● | ● | ● | ● | ● | ● | |
| 240 | ~ | 243 | | | ● | ● | ● | ● | ● | ● | ● | ● | |
| 244 | ~ | 247 | ● | | ● | ● | ● | ● | ● | ● | ● | ● | |
| 248 | ~ | 251 | | ● | ● | ● | ● | ● | ● | ● | ● | ● | |
| 252 | ~ | 255 | ● | ● | ● | ● | ● | ● | ● | ● | ● | ● | |

FIG. 13

| INPUT | 205 | 206 | 207 | 208 | 209 | 210 | 211 | 212 | 213 | 214 | 215 |
|---|---|---|---|---|---|---|---|---|---|---|---|
| (a) | 206 | 208 | 212 | 216 | 218 | 216 | 216 | 216 | 216 | 216 | 216 |
| (b) | 204 | 203 | 202 | 200 | 202 | 204 | 206 | 208 | 210 | 212 | 214 |

FIG. 16

→TIME

| DIGITAL IMAGE SIGNAL LEVEL | | | 12 | 11 | 10 | 9 | 8 | 7 | 6 | 5 | 4 | 3 | SUBFIELD SF NUMBER |
|---|---|---|---|---|---|---|---|---|---|---|---|---|---|
| | | | 48 | 40 | 36 | 32 | 28 | 24 | 20 | 12 | 8 | 4 | WEIGHTING |
| 0 | ~ | 3 | | | | | | | | | | | |
| 4 | ~ | 7 | | | | | | | | | | ● | |
| 8 | ~ | 11 | | | | | | | | | ● | | |
| 12 | ~ | 15 | | | | | | | | | ● | ● | |
| 16 | ~ | 19 | | | | | | | | ● | | ● | |
| 20 | ~ | 23 | | | | | | | | ● | ● | | |
| 24 | ~ | 27 | | | | | | | | ● | ● | ● | |
| 28 | ~ | 31 | | | | | | | ● | | ● | | |
| 32 | ~ | 35 | | | | | | | ● | | ● | ● | |
| 36 | ~ | 39 | | | | | | | ● | ● | | ● | |
| 40 | ~ | 43 | | | | | | | ● | ● | ● | | |
| 44 | ~ | 47 | | | | | | | ● | ● | ● | ● | |
| 48 | ~ | 51 | | | | | | ● | | ● | ● | ● | |
| 52 | ~ | 55 | | | | | | ● | ● | | ● | | |
| 56 | ~ | 59 | | | | | | ● | ● | | ● | ● | |
| 60 | ~ | 63 | | | | | | ● | ● | ● | | ● | |
| 64 | ~ | 67 | | | | | | ● | ● | ● | ● | | |
| 68 | ~ | 71 | | | | | | ● | ● | ● | ● | ● | |
| 72 | ~ | 75 | | | | | ● | | ● | ● | ● | ● | |
| 76 | ~ | 79 | | | | | ● | ● | | ● | ● | ● | |
| 80 | ~ | 83 | | | | | ● | ● | ● | | ● | | |
| 84 | ~ | 87 | | | | | ● | ● | ● | | ● | ● | |
| 88 | ~ | 91 | | | | | ● | ● | ● | ● | | ● | |
| 92 | ~ | 95 | | | | | ● | ● | ● | ● | ● | | |
| 96 | ~ | 99 | | | | | ● | ● | ● | ● | ● | ● | |
| 100 | ~ | 103 | | | | ● | | ● | ● | ● | ● | ● | |
| 104 | ~ | 107 | | | | ● | ● | | ● | ● | ● | ● | |
| 108 | ~ | 111 | | | | ● | ● | ● | | ● | ● | ● | |
| 112 | ~ | 115 | | | | ● | ● | ● | ● | | ● | | |
| 116 | ~ | 119 | | | | ● | ● | ● | ● | | ● | ● | |
| 120 | ~ | 123 | | | | ● | ● | ● | ● | ● | | ● | |
| 124 | ~ | 127 | | | | ● | ● | ● | ● | ● | ● | | |
| 128 | ~ | 131 | | | ● | | ● | ● | ● | ● | ● | | |
| 132 | ~ | 135 | | | ● | ● | | ● | ● | ● | ● | | |
| 136 | ~ | 139 | | | ● | ● | ● | | ● | ● | ● | | |
| 140 | ~ | 143 | | | ● | ● | ● | ● | | ● | ● | | |
| 144 | ~ | 147 | | | ● | ● | ● | ● | ● | | | ● | |
| 148 | ~ | 151 | | | ● | ● | ● | ● | ● | | ● | | |
| 152 | ~ | 155 | | | ● | ● | ● | ● | ● | | ● | ● | |
| 156 | ~ | 159 | | | ● | ● | ● | ● | ● | ● | | ● | |
| 160 | ~ | 163 | | | ● | ● | ● | ● | ● | ● | ● | | |
| 164 | ~ | 167 | | | ● | ● | ● | ● | ● | ● | ● | ● | |
| 168 | ~ | 171 | | ● | | ● | ● | ● | ● | ● | ● | ● | |
| 172 | ~ | 175 | | ● | ● | | ● | ● | ● | ● | ● | ● | |
| 176 | ~ | 179 | | ● | ● | ● | | ● | ● | ● | ● | ● | |
| 180 | ~ | 183 | | ● | ● | ● | ● | | ● | ● | ● | ● | |
| 184 | ~ | 187 | | ● | ● | ● | ● | ● | | ● | ● | ● | |
| 188 | ~ | 191 | | ● | ● | ● | ● | ● | ● | | ● | | |
| 192 | ~ | 195 | | ● | ● | ● | ● | ● | ● | | ● | ● | |
| 196 | ~ | 199 | | ● | ● | ● | ● | ● | ● | ● | | ● | |
| 200 | ~ | 203 | | ● | ● | ● | ● | ● | ● | ● | ● | | |
| 204 | ~ | 207 | | ● | ● | ● | ● | ● | ● | ● | ● | ● | |
| 208 | ~ | 211 | ● | | ● | ● | ● | ● | ● | ● | ● | | |
| 212 | ~ | 215 | ● | ● | | ● | ● | ● | ● | ● | ● | | |
| 216 | ~ | 219 | ● | ● | ● | | ● | ● | ● | ● | ● | | |
| 220 | ~ | 223 | ● | ● | ● | ● | | ● | ● | ● | ● | | |
| 224 | ~ | 227 | ● | ● | ● | ● | ● | | ● | ● | ● | | |
| 228 | ~ | 231 | ● | ● | ● | ● | ● | ● | ● | ● | ● | | |
| 232 | ~ | 235 | ● | ● | ● | ● | ● | ● | | ● | ● | ● | |
| 236 | ~ | 239 | ● | ● | ● | ● | ● | ● | ● | | ● | | |
| 240 | ~ | 243 | ● | ● | ● | ● | ● | ● | ● | ● | | | |
| 244 | ~ | 247 | ● | ● | ● | ● | ● | ● | ● | ● | | ● | |
| 248 | ~ | 251 | ● | ● | ● | ● | ● | ● | ● | ● | ● | | |
| 252 | ~ | 255 | ● | ● | ● | ● | ● | ● | ● | ● | ● | ● | |

FIG. 17

| INPUT | 9 | 10 | 11 | 12 | 13 | 14 | 15 |
|---|---|---|---|---|---|---|---|
| (a) | 10 | 11 | 12 | 16 | 16 | 16 | 16 |
| (b) | 8 | 9 | 10 | 8 | 10 | 12 | 14 |

IMAGE DISPLAY APPARATUS WITH SELECTED COMBINATIONS OF SUBFIELDS DISPLAYED FOR A GRAY LEVEL

BACKGROUND OF THE INVENTION

1. Field of the Invention

The present invention relates to an image display apparatus which uses a display panel, such as a plasma display panel, that displays an image in a multi-level gray scale by dividing one TV field of the image into a plurality of subfields, and especially to an image display apparatus for reducing halftone disturbance which occurs when displaying a moving image.

2. Description of the Prior Art

Image display apparatuses which use display panels that have two display states in which each pixel can be "on" or "off", represented in this specification by plasma display panels (hereinafter simply referred to as "PDPs"), produce gray-level images by display methods such as the Address Display Period Separated Sub Field method. In this method, an image is displayed by dividing the time in one TV field into a plurality of subfields that are each composed of an addressing period in which "on"/"off" data is written for each line of a PDP screen and a discharge sustaining period in which predetermined pixels are illuminated all at once.

It is conventionally known that when displaying a moving image in a multi-level gray scale by dividing each TV field of the moving image into a plurality of subfields, gray level disturbance in the form of false-edge appears on the screen.

The following is an explanation of an occurrence of such false-edges when displaying a moving image, with reference to FIGS. 18 and 19. FIG. 18 shows movement of a picture pattern PA1 on a screen of a PDP 180, the picture pattern PA1 being composed of two pairs of adjacent pixels having the similar gray levels 127 and 128 respectively. In this example, the picture pattern PA1 moves by two pixels per TV field. In FIG. 19, the horizontal axis shows a relative position of each pixel on the screen, and the vertical axis shows a period which for convenience's sake corresponds to one TV field. FIG. 19 also shows how the movement of the picture pattern PA1 appears to a viewer. Here, a case is explained in which each 8-bit gray level, that is, each of 256 gray levels, is converted into 8-bit data showing "on"/"off" states of eight subfields, which is then used for displaying the corresponding gray level. As a specific example, the time in one TV field is divided into subfields 1–8 which are assigned weightings of 1, 2, 4, 8, 16, 32, 64 and 128, respectively (in ascending order). In this case, the gray level 127 can be displayed by lighting the subfields 1–7 (diagonally shaded areas on the left in FIG. 19) and not lighting the subfield 8, while the gray level 128 can be displayed by not lighting the subfields 1–7 and lighting the subfield 8 (diagonally shaded area on the right in FIG. 19). Though in FIG. 19 the lighting of each subfield appears to be continuous for a predetermined length, each subfield in the PDP is actually composed of a set of pulse illuminations corresponding to its weighting value, so that each subfield has an interval that is equal to the addressing period.

When displaying a static image, the average luminance of one TV field of the observed image is expressed by the integral of the lighting periods between A-A' in FIG. 19, so that the desired gray level is properly displayed. On the other hand, when displaying a moving image, an integral of the lighting periods of either B B' or C-C', depending on the direction followed by the eye, is observed on the retina. The total value of each bit (subfield) between B B' is approximately 0, while the total value of each bit (subfield) between C-C' is approximately 255. Thus, when observing the movement of a picture pattern in which two similar gray levels, such as the gray levels 127 and 128, are adjacent, the gray levels in the level changing part appear profoundly disturbed due to the movement of the image as shown in FIG. 19.

As explained above, a halftone is represented by an integral of luminance values of each subfield in a time series. Accordingly, when the eye follows a moving image, weighting values of bits which are in a different position from the original pixel position are integrated, and as a result the halftone display appears profoundly disturbed. It should be noted here that this halftone disturbance appears as false-edges in the image, and so generally referred to as the "moving image false-edge". Such false-edge occurrences in a moving image display are explained in detail in Hiraki Uchiike and Shigeru Mikoshiba *All About Plasma Display* Kogyo Chosakai, Tokyo (May 1, 1997): pp. 165–177.

In order to eliminate moving image false-edges and reduce halftone disturbance in a moving image display, an attempt has been made with conventional image display apparatuses to divide a total weighting value of the subfields 7 and 8 which correspond to the high-order bits and intersperse the divided parts in the first and second halves of one field. FIG. 20 shows a subfield construction in a conventional method for reducing the moving image false-edges by using ten subfields to display 8-bit gray levels, that is, 256 gray levels. These subfields are assigned weightings of 48, 48, 1, 2, 4, 8, 16, 32, 48, and 48 in order of time. That is to say, the combined weighting value of 64 and 128 for the high-order subfields 7 and 8 out of the eight subfields described above is divided into four equal weightings ((64+128)/4=192/4=48×4), which are then interspersed in the first and second halves of one field to prevent the occurrence of the halftone disturbance by reducing the weighting values of the high-order subfields. With this technique, halftone disturbance is scarcely observed in the gray level changing area between 127 and 128 described above, so that the occurrence of the moving image false-edges can be prevented for those values. However, for a different example, like the gray level change from 63 to 64 shown in FIG. 20 in which a subfield with a large weighting (here, the subfield 9) is turned "on" for the first time while subfields with small weightings (here, the subfields 3, 4, 5, 6, and 8) are turned "off", the distribution of "on" subfields and "off" subfields is greatly changed. As a result, halftone disturbance is inevitably observed in the level changing area. As shown in FIG. 20, a gray level observed in the direction of the arrow (a) is approximately 79, while a gray level observed in the direction of the arrow (b) is approximately 32. Thus, it is still not possible to prevent the occurrence of the moving image false-edges when displaying a moving image in such gray levels.

Also, when using such a subfield dividing method that divides the total weighting value of the high-order bits and intersperses the divided parts in the first and second halves of one TV field, four subfields with a weighting of "48" which have been interspersed in a time series within the TV field comprise a weighting value of 192, occupying a large portion of the total weighting value of 255. Usually, an observed image is composed of image components which are interspersed in the time series. Thus, in the subfield dividing method which intersperses each subfield with a large weighting in the first and second halves of one field, when displaying a moving image in a high-luminance area using these subfields, the observed image will be a composition of image components which are displayed using the subfields with the weighting of "48". This often causes the moving image to appear blurred. The appearance of such blurs in the moving image display affects picture quality, such as by making small moving characters appear double so that they cannot be read.

SUMMARY OF THE INVENTION

It is an object of the present invention to provide an image display apparatus which can reduce occurrences of moving image false-edges by preventing profound changes in "on"/"off" subfield distribution, and which can display a sharp image that does not appear blurred.

The above object can be fulfilled by dividing one TV field of an input image signal as follows, and by combining subfields that are "on" as follows. A luminance weighting is assigned to each subfield such that subfields, other than those with relatively small weightings, are arranged in a substantially increasing or decreasing order of weighting, and all of the subfields are divided into a first group of relatively small weightings and a second group of relatively large weightings (weightings larger than those of the first group). A total value of the respective luminance weightings of a TV field of N gray levels with M subfields, the respective luminance weightings being each different, is "N−1", wherein a formula "M>(log N/log 2)" is satisfied. Weightings of the subfields of the first group form a geometric series, while weightings of the subfields of the second group approximate to an arithmetic series. This assignment of weightings can be carried out by dividing one field into a plurality of subfields so that when representing a gray level $2^P$ (P being an integer equal to or larger than 1), (p+1) or more subfields will not have the same weighting.

With the field division and weighting assignment described above, a gray level can be displayed by selecting an "on"/"off" subfield combination, out of possible "on"/"off" subfield combinations for displaying the gray level, in which a number of subfields with large weightings that are "on" is minimized.

With the above gray level display method, by assigning weightings to low-order subfields in a combination similar to the common binary system, a low luminance part in which moving image false-edges rarely appear can be displayed with a minimum number of subfields. On the other hand, by assigning weightings which increase or decrease by an approximately predetermined difference to other subfields, a middle or high luminance part can be displayed in a way which eliminates most moving image false-edges. On the whole, it is possible to display an image in a multi-level gray scale with few moving image false-edges, while limiting a total number of subfields to a relatively small number (twelve subfields).

In other words, by displaying gray levels as described above, it is possible to minimize "on"/"off" subfield distribution changes, so that the profound changes in the "on"/"off" subfield distribution which are the main cause of the moving image false-edge occurrences can be suppressed.

Additionally, subfields with relatively large weightings will not be "on" in disparate parts of a same TV field. As a result, it is possible to display a sharp image which does not appear blurred in a high luminance area.

In particular, when the gray level increases by one level and as a result it becomes necessary to turn "on" a subfield which has a larger weighting than the currently "on" subfields, there is a possibility that the "on"/"off" subfield distribution profoundly changes. However, by selecting an "on"/"off" subfield combination, out of possible "on"/"off" subfield combinations for displaying this increased gray level, in which a subfield adjacent to a subfield with a larger weighting that is "on" is turned "off", the "on"/"off" subfield distribution changes will be interspersed in a time series, so that the moving image false-edge occurrences can be effectively suppressed.

Also, by lighting subfields after converting (altering) an original gray level within a predetermined range into a plurality of higher or lower gray levels, "on"/"off" subfield distribution changes can be further suppressed in the gray level range in which the moving image false-edges tend to appear. As a result, the moving image false-edge occurrences can be more effectively suppressed.

Furthermore, since there is still a possibility that a pixel whose gray level has been altered may stand out, a moving image may be displayed as a checkered pattern in which a gray level is alternately converted to a higher or lower level for each adjacent pixel, so that the average gray level of the image will be unaffected and the image quality will not be degraded.

When displaying 256 levels of gray, one TV field can be specifically divided into: nine subfields with the weighting ratio of 1:2:4:8:16:32:48:64:80; ten subfields with the weighting ratio of 1:2:4:8:16:24:32:48:56:64; eleven subfields with the weighting ratio of 1:2:4:8:16:24:32:36:40:44:48; twelve subfields with the weighting ratio of 1:2:4:8:12:20:24:28:32:36:40:48; or twelve subfields with the weighting ratio of 1:2:4:8:12:16:24:28:32:36:44:48.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings:

FIG. 3 shows a table for converting an 8-bit input digital image signal into "on"/"off" subfield information in the image display apparatus;

FIG. 13 shows a table showing the correspondence between original gray levels and altered gray levels when converting gray levels within a gray level range centered on the gray level 208 into a plurality of gray levels;

FIG. 16 shows another table for converting an 8-bit input digital image signal into "on"/"off" subfield information;

FIG. 17 is a table for explaining modified examples when altering a gray level within a predetermined range into a plurality of gray levels;

DESCRIPTION OF THE PREFERRED EMBODIMENT

First Embodiment

Figure 1:
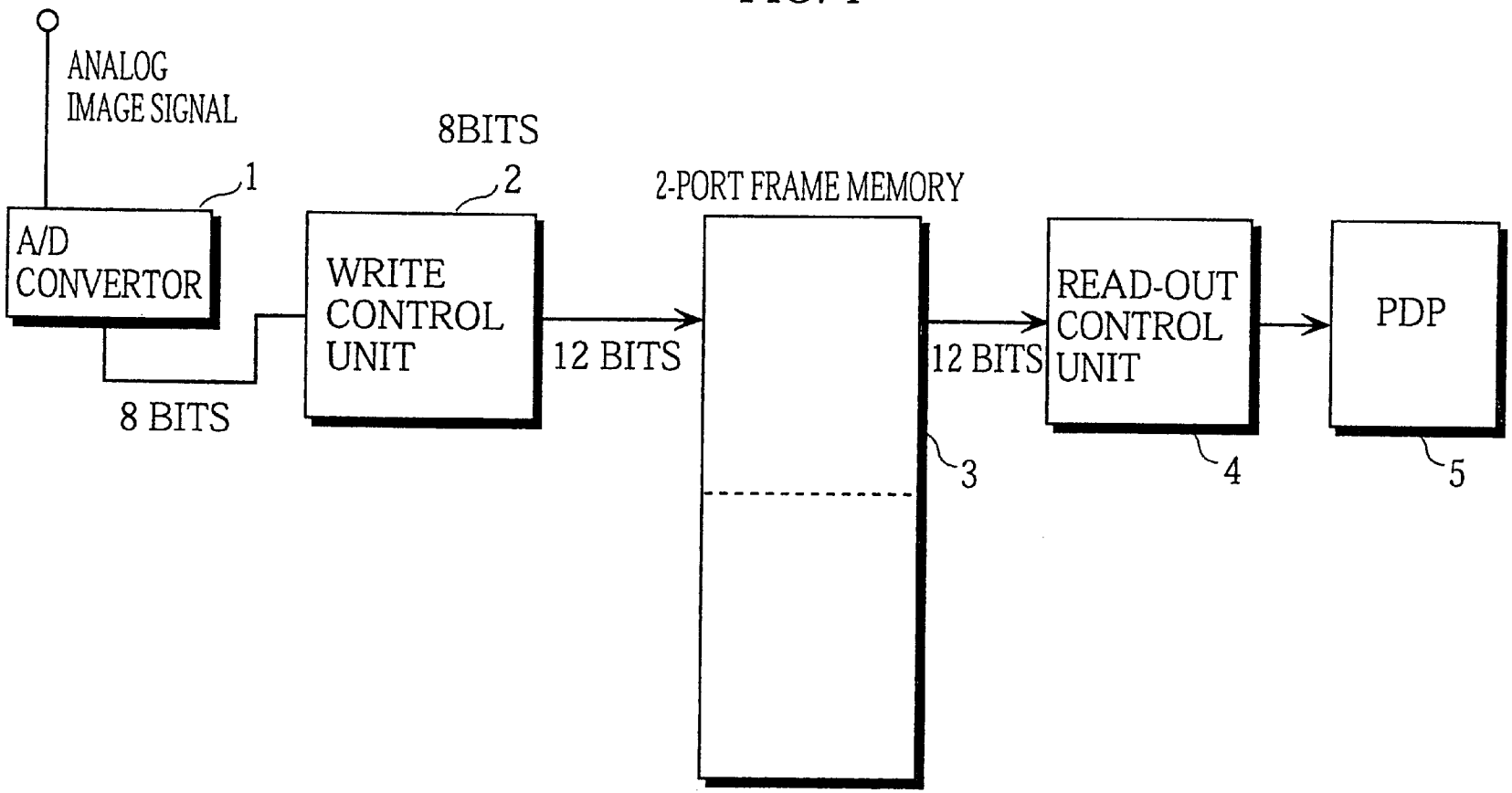
FIG. 1 is a block diagram showing the construction of the image display apparatus of the first embodiment.

FIG. 1 is a block diagram showing the construction of the image display apparatus of the present embodiment.

As shown in FIG. 1, the image display apparatus of the present embodiment includes a PDP 5, an A/D convertor 1 for converting an input image signal into an 8-bit digital signal, a write control unit 2 for rearranging the image levels represented by the 8-bit digital signal into a 12-bit signal composed of twelve subfields, a frame memory 3 for storing the rearranged 12-bit signal, and a read-out control unit 4 for reading image signals for each TV field from the frame memory 3 to the PDP 5.

The PDP 5 is a display device provided with electrodes so that the screen is a matrix of 640 (that is 640 pixels per line) by 480 pixels, for example, with each pixel having two states of illumination that are namely "on" and "off". Here, gray levels can be displayed by expressing each gray level as a total of the illumination values of twelve subfields, where each subfield is given a predetermined number of illumination pulses as a weighting. A PDP for monochrome display is described in the present embodiment to simplify the explanation, though the technique of the present embodiment can also be applied to the processing of each color in PDPs for color display which generate pixels using the three colors red (R), green (G), and blue (B).

The A/D convertor 1 converts an input analog image signal which has been converted from an interlaced scanning signal to a sequential scanning signal into an 8-bit image signal showing a 256-level gray scale.

Figure 2:
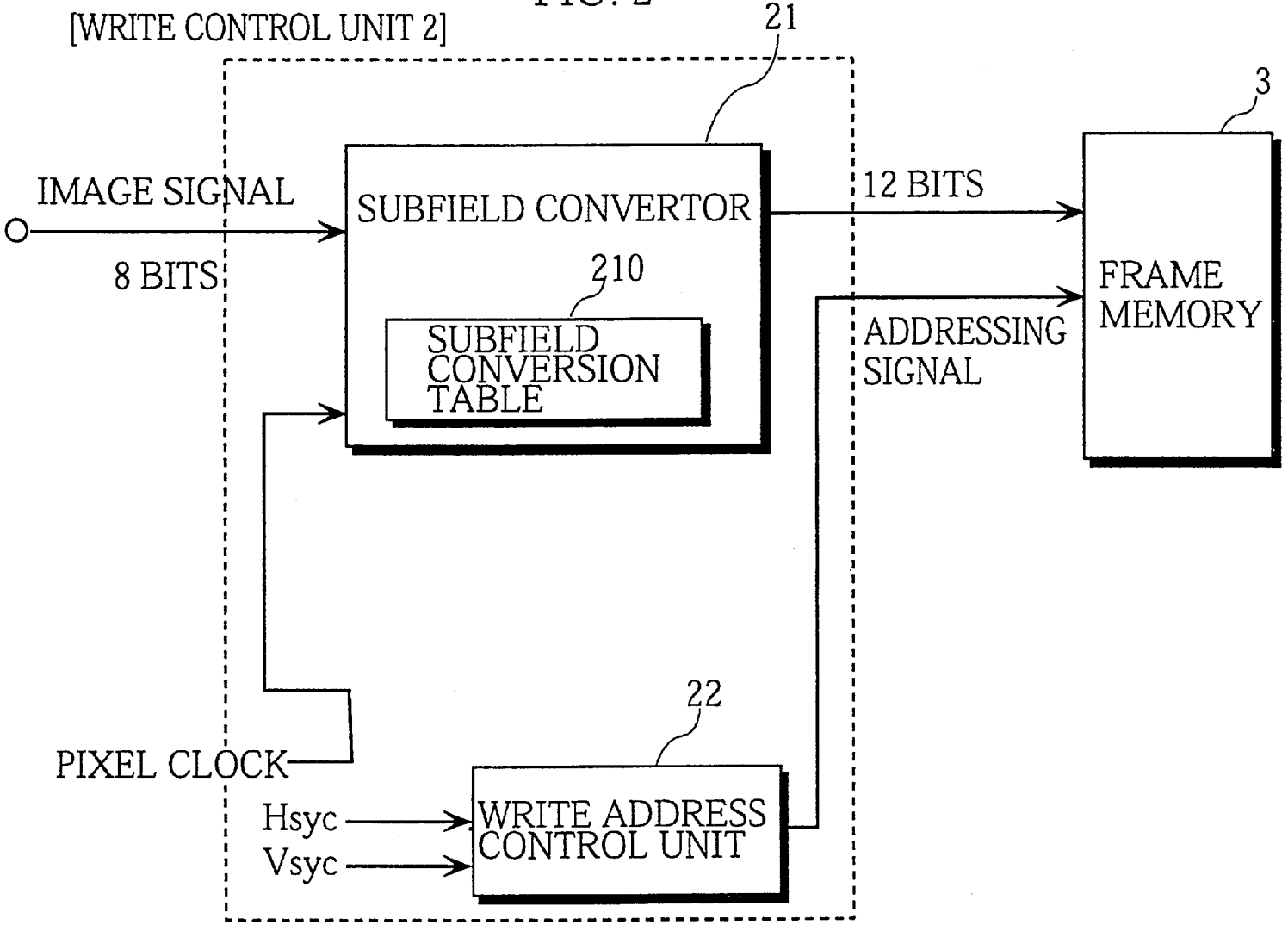
FIG. 2 is a block diagram showing the construction of the write control unit 2 in the image display apparatus.

FIG. 2 is a block diagram showing the construction of the write control unit 2.

As shown in the figure, the write control unit 2 includes a subfield convertor 21 and a write address control unit 22.

The write address control unit 22 generates an addressing signal based on a horizontal synch signal and a vertical synch signal which have been separated from the input image signal.

The subfield convertor 21 is a circuit which converts an 8-bit digital image signal corresponding to each pixel into field information of 12 bits which each have a predetermined weighting. The 12-bit field information is a set of 1-bit subfield information showing which of the subfields (time periods) within one TV field are "on". Here, the subfield convertor 21 stores a subfield conversion table 210 which it uses to divide the 8-bit digital image signal for each pixel into information composed of a predetermined number of subfields in accordance with a gray level of the digital image signal. This division processing for each pixel is carried out in synchronization with a pixel clock. Then a physical address is specified for the generated field information corresponding to each pixel by the addressing signal outputted from the write address control unit 22, and the field information is written into the frame memory 3 for each line, each pixel, and each field (screen).

FIG. 3 shows the subfield conversion table 210. As shown in the figure, the subfield conversion table 210 is used for converting each image signal into 12-bit "on"/"off" information for subfields SF1 to SF12. In the table, each row shows a level of each input digital image signal, while the columns show the 12-bit field information into which the input digital image signal should be converted. A bulleted box means that the subfield is "on", while an unbulleted box means that the subfield is "off". The low order 2 bits are not shown in the table since they are used for controlling "on"/"off" states of the subfields SF1 and SF2 within each set of four consecutive levels.

For example, when a digital image signal whose level is 128 is inputted in the subfield convertor 21, the image signal is converted into 12-bit data of "000111110100" based on the subfield conversion table 210. Here, each subfield of "1" is "on", while each subfield of "0" is "off".

Figure 4:
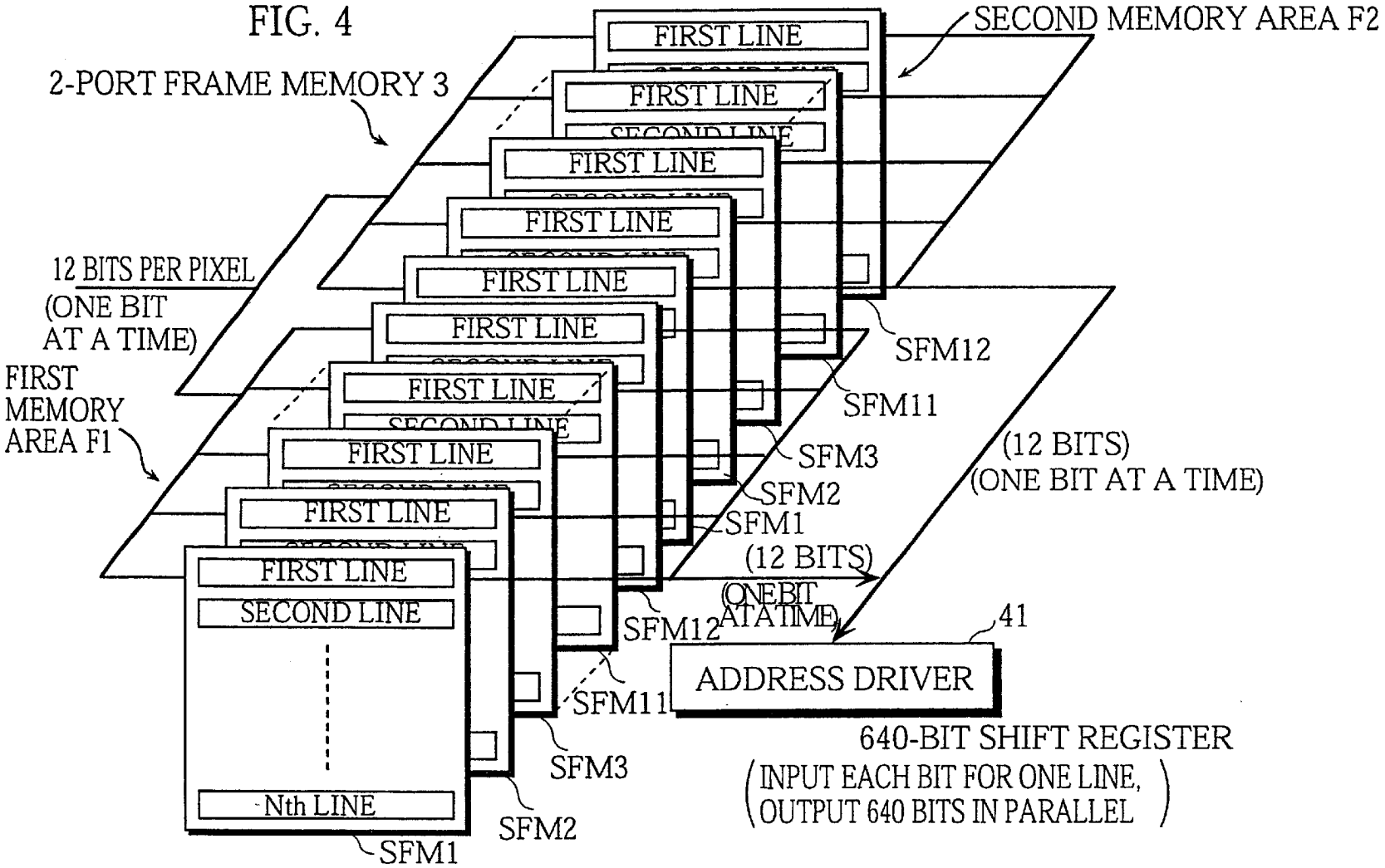
FIG. 4 shows the construction of the frame memory 3 in the image display apparatus.

FIG. 4 shows the internal construction of the frame memory 3. As shown in the figure, the frame memory 3 is provided with a first memory area F1 for storing field information of one field and a second memory area F2 for storing field information of another field. Each of the memory areas F1 and F2 is composed of twelve subfield memories SFM1–SFM12. With this construction, field information showing 12-bit subfield combinations for two fields is written into two sets of subfield memories SFM1–SFM12 as "on"/"off" subfield information. In the present embodiment, a 1-bit input/output semiconductor memory is used as each of the subfield memories SFM1–SFM12. The frame memory 3 is a two-port frame memory which is capable of simultaneously writing field information from the write control unit 2 and reading field information to the PDP 5.

Field information is alternately written into two memory areas F1 and F2 in the frame memory 3, such that field information of a present field is written into the first memory area F1, and then field information of a next field is written into the second memory area F2. In writing field information into one memory area (F1 or F2), each bit of the 12-bit data outputted from the subfield convertor 21 in synchronization with the pixel clock is written into one of the twelve subfield memories SFM1–SFM12. Here, it is predetermined which of 12 bits is to be stored into which of the subfield memories SFM1–SFM12.

More specifically, the subfield numbers SF1–SF12 in the subfield conversion table 210 are logically associated with the subfield memories SFM1–SFM12 in numerical order. Accordingly, one bit of the 12-bit data with a certain subfield number is written into a subfield memory of the same number out of the subfield memories SFM1–SFM12. A write position of the 12-bit data in the subfield memories SFM1–SFM12 is specified by the addressing signal outputted from the write address control unit 22. Usually, the 12-bit data is written into the same position as the position of the pixel signal on the screen before the pixel signal is converted into the 12-bit data.

Figure 5:
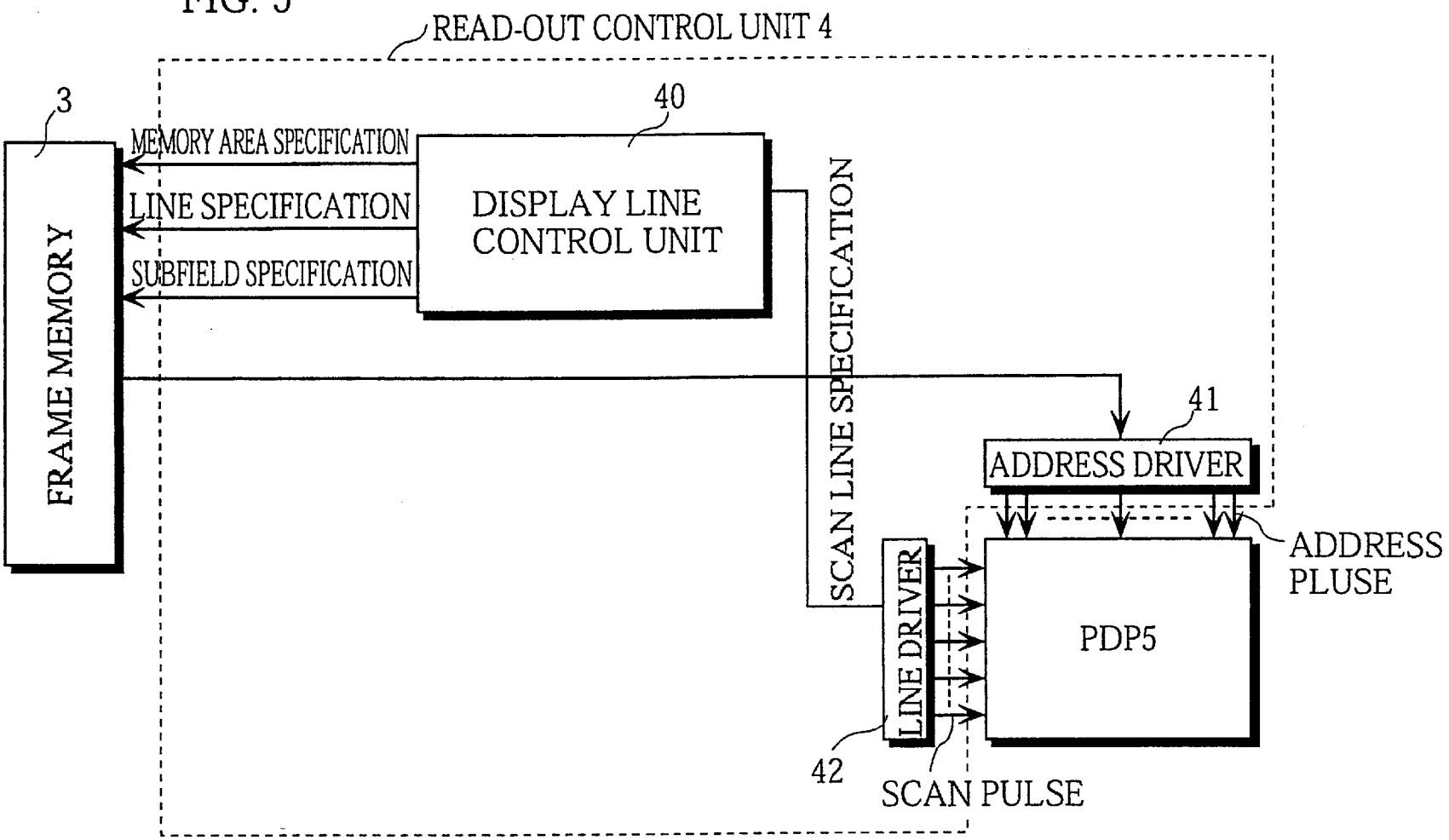
FIG. 5 is a block diagram showing the construction of the read-out control unit 4 in the image display apparatus.

As shown in FIG. 5, the read-out control unit 4 includes a display line control unit 40, an address driver 41, and a line driver 42.

The display line control unit 40 tells the frame memory 3 which memory area (F1 or F2), line, and subfield should be read to the PDP 5, and tells the PDP 5 which line should be scanned.

The operation of the display line control unit 40 is synchronized with the writing operation of the write control unit 2 so as to be performed on different fields. That is to say, the display line control unit 40 does not request the read-out from a memory area (F1 or F2) into which 12-bit data is being written by the write control unit 2, but requests the read-out from the other memory area (F2 or F1) into which 12-bit data has already been written.

The address driver 41 converts 640-bit subfield information corresponding to the number of pixels in one line which has been inputted in one bit units in series from the frame memory 3 into address pulses in parallel in accordance with memory area specification, line specification, and subfield specification by the display line control unit 40, and outputs the address pulses to the PDP 5.

The line driver 42 generates a scan pulse to specify a line into which the subfield information is to be written using the scan pulse.

With this construction of the read-out control unit 4, field information is read from the frame memory 3 to the PDP 5 as follows. The read-out of field information for one field which has been written in the frame memory 3 is performed by reading subfield information for each pixel from the subfield memories SFM1, SFM2, . . . , and SFM12 in sequence. First, one bit of subfield information for each pixel on a first line is successively read from the subfield memory SFM1 and inputted in the address driver 41. After the line is specified by the line driver 42, a latent image is formed (addressing is carried out) on the first line. Next, one bit of subfield information for each pixel on a second line is successively read from the subfield memory SFM1 and inputted serially in the address driver 41 in the same way. Then the inputted 640-bit subfield information is outputted in parallel to the PDP 5 and addressing is carried out. On completing the read-out for all X lines on the screen (X being 480 in the present example), each pixel on the screen is simultaneously illuminated.

Similarly, "on"/"off" subfield information for the subfield SF2 for each pixel of each line is read from the subfield memory SFM2, and each addressing is carried out. The same operation is successively repeated for the rest of the subfields. On completing this operation for all of the subfields SF1–SF12, the read-out of field information for one field ends.

Figure 6:
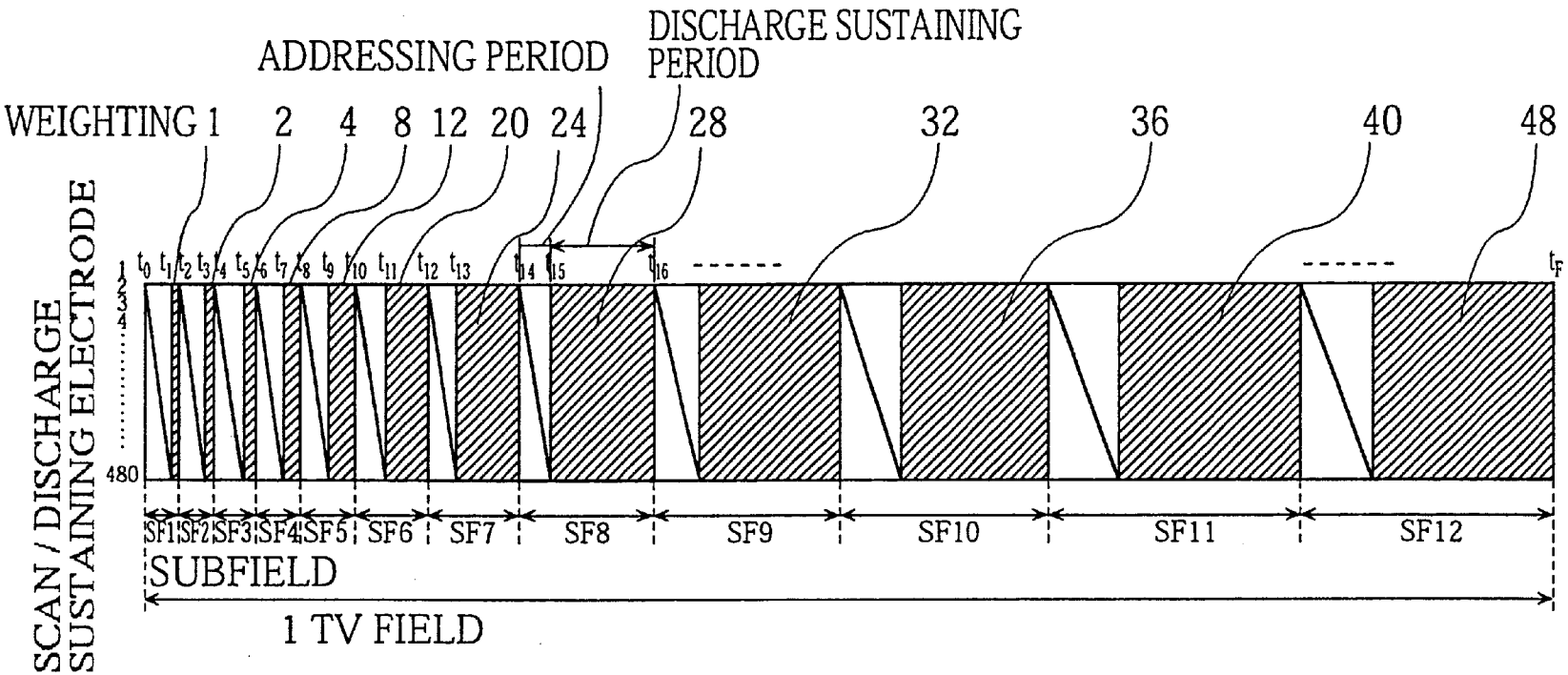
FIG. 6 shows an illuminating method of the PDP 5 in the image display apparatus.

FIG. 6 shows the operation of the PDP 5. In FIG. 6, the horizontal axis shows time, while the vertical axis shows scan/discharge sustaining electrode numbers, the electrodes running across the PDP. Also, a thick slanted line shows an addressing period in which addressing of pixels to be illuminated is carried out, while a shaded area shows the discharge sustaining period for which illumination of the pixels is carried out. That is to say, addressing is performed for all pixels for the scan/discharge sustaining electrode 1 by applying address pulses to the addressing electrodes in the vertical axis of the PDP at the start of the subfield SF1. On completing the addressing of the scan/discharge sustaining electrode 1, the same addressing processing is repeated for the electrode 2, 3, . . . , and the last electrode. Completion of the addressing of the last scan/discharge sustaining electrode is followed by the discharge sustaining period t1–t2. During this period, a number of discharge sustaining pulses proportional to the weighting of the subfield SF1 are applied to each discharge sustaining electrode, wherein only pixels which have been specified by the addressing as being illuminated are illuminated. By repeating the addressing and subsequent simultaneous illumination of pixels for all twelve subfields, a gray-level display of one field is completed. It should be noted here that each addressing is carried out after an initialization period (not illustrated) for eliminating wall charges of all pixels.

By reading field information of a next field which has been written into one memory area during the read-out of field information of the present field from the other memory area as described above, a moving image is displayed.

Luminance Weighting

Figure 7:
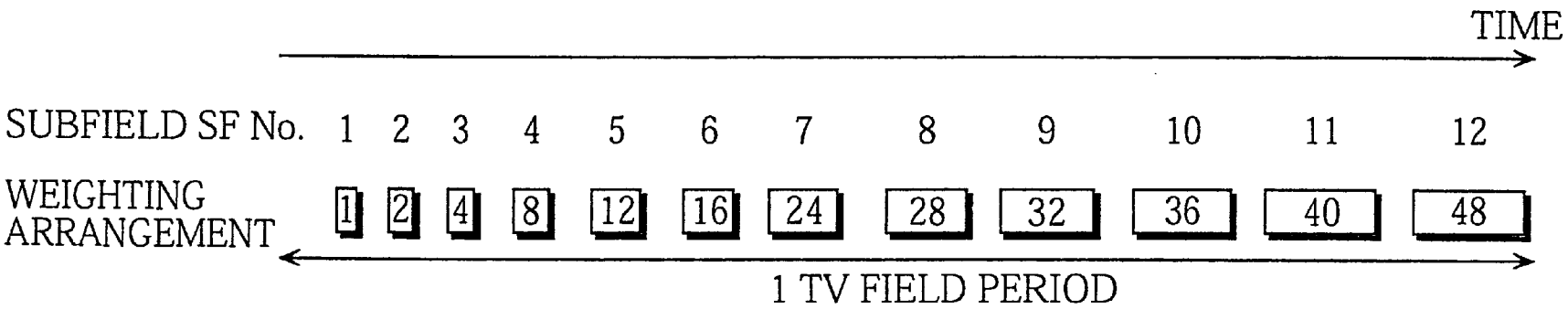
FIG. 7 shows a division model of one TV field in the image display apparatus.

In the subfield conversion table 210, the number of subfields is twelve, which are assigned weightings of 1, 2, 4, 8, 12, 20, 24, 28, 32, 36, 40, and 48 in order of time as shown in FIG. 7. The weightings are assigned to the subfields so that the subfields can be classified into two groups. The first group is composed of subfields with low-order (i.e., small) weightings and includes L (L being an integer equal to or larger than two) subfields that are assigned weightings which are powers of two within a range of 1 and $2^{(L-1)}$ (those values being expressed by a geometrical series). This first group corresponds to the subfields SF1 to SF4 that have the respective weightings 1, 2, 4, and 8. The second group is composed of high-order (i.e., large) weightings and includes weightings that are greater than $2^{(L-1)}$ and that rise or fall by an almost uniform amount (the values approximately to those appearing in an arithmetic series). This second group corresponds to the subfields SF5 to SF12 which have the respective weightings 12, 20, 24, 28, 32, 36, 40, and 48. Four subfields SF1–SF4 and eight subfields SF5–SF12 are arranged in ascending order of the weighting.

Since the high-order weightings increase in an arithmetic series, one high-order subfield luminance can be represented by a combination of a plurality of low-order subfields. Thus, there are cases in which several subfield combinations are possible for displaying a certain gray level. For instance, when displaying a digital image signal whose level is 127, a combination of subfields SF1, SF2, SF4, SF5, SF6, SF7, SF8, and SF9, a combination of SF1, SF2, SF10, SF11, and SF12, a combination of SF1, SF2, SF3, SF5, SF9, SF10, and SF11, and a combination of SF1, SF2, SF4, SF6, SF8, SF9, and SF10 are possible. When displaying a digital image signal whose level is 128, a combination of SF4, SF5, SF6, SF7, SF8, and SF10, a combination of SF3, SF10, SF11 and SF12, a combination of SF4, SF5, SF9, SF10, and SF11, a combination of SF4, SF7, SF8, SF9, and SF10, and a combination of SF5, SF6, SF8, SF9, and SF10 are possible.

Among a plurality of possible subfield combinations for representing one gray level, on combination is given in the subfield conversion table 210. For the digital image signal of the level 127, the combination of SF1, SF2, SF4, SF5, SF6, SF7, SF8, and SF9 is given in the table, while for the digital image signal of the level 128, the combination of SF4, SF5, SF6, SF7, SF8, and SF10 is given in the table.

It can be said that combinations which minimize the use of subfields with high-order weightings are given in the subfield conversion table 210. As shown in the subfield conversion table 210 in FIG. 3, such combinations are used for gray levels of middle to high luminances (12–255), but not for gray levels of low luminances (0–11).

Also, the following characteristic can be seen in the table as shown in changes in subfield combinations from luminances 99 to 100, from 127 to 120, from 167 to 168, and from 207 to 208. When displaying a luminance (100, 128, 168, 208) in which a subfield with a large weighting which was "off" when displaying a one-level lower luminance (99, 127, 167, 207) is turned "on", a subfield whose weighting is next lower than the subfield that is turned "on" will be turned "off". This characteristic can be clearly seen in the subfield conversion table 210, in which the subfield SF8 with a weighting of 28 in the luminance 100, the subfield SF9 with a weighting of 32 in the luminance 128, the subfield SF10 with a weighting of 36 in the luminance 168, and the subfield SF11 with a weighting of 40 in the luminance 208 are "off".

By using such subfield combinations to display an image, a low luminance part in which moving image false-edges rarely appear can be displayed with a minimum number of subfields, while a middle or high luminance part can be displayed by effectively eliminating most moving image false-edges. On the whole, it is possible to display the moving image in a multi-level gray scale with few moving image false-edges, while limiting a total number of subfields to a small number (twelve subfields).

The following is an explanation of effect of suppressing the occurrence of moving image false-edges by the above display method using specific examples.

The "on"/"off" subfield pattern shown in the subfield conversion table 210 in FIG. 3 can be seen as a state which is observed when a moving image with adjacent gray levels is displayed. In this case, the vertical direction represents a relative pixel position, while the horizontal direction represents time.

For instance, when a moving image is an image pattern composed of adjacent gray levels of 124–127, the observed image will be of the order of gray level 124 as shown by the dashed arrow 1 in FIG. 3, so that moving image false-edges will not appear.

This is because a subfield combination which minimizes the use of subfields with high-order weightings is selected for displaying the gray levels 124–127 from the possible subfield combinations for displaying the gray levels. As described above, possible subfield combinations for displaying the gray levels 124–127 include a combination of subfields SF4, SF5, SF6, SF7, SF8, and SF9, a combination of SF10, SF11, and SF12, a combination of SF3, SF5, SF9, SF10, and SF11, and a combination of SF4, SF6, SF8, SF9, and SF10, aside from the low-order 2 bits SF1 and SF2. Among these combinations, a combination which uses a largest possible number of subfields and so minimizes the number of subfields with large weightings is selected. By selecting such a subfield combination, when a gray level changes, the "on"/"off" subfield distribution will not change profoundly, so that gray level disturbance and moving image false-edges can be prevented.

By using such a combination which minimizes the use of subfields with large weightings, the following rule can be seen when, for example, displaying a moving image pattern with the adjacent digital image signal levels 127 and 128.

As shown in FIG. 3, while the gray level 127 is represented by the combination of SF1, SF2, SF4, SF5, SF6, SF7, SF8, and SF9, the gray level 128 is represented by the combination of SF4, SF5, SF6, SF7, SF8, and SF10 which minimizes the use of subfields with large weightings among the plurality of possible subfield combinations mentioned above. Thus, there is a rule of prioritizing a combination in which a subfield (SF9) adjacent to a highest-order subfield that is turned "on" (SF10) becomes "off".

This rule can be seen in cases when it becomes necessary to turn "on" a subfield with a weighting larger than subfields which are presently "on" (such as 167–168 and 207–208). In such cases, there is a possibility that the "on"/"off" subfield distribution profoundly changes. However, by using the above type of combinations, the "on"/"off" subfield distribution changes can be interspersed in the time direction of one TV field, so that the occurrence of most moving image false-edges can be equivalently suppressed. Thus, it is effective to use the combination in which a subfield adjacent to a highest-order subfield that is turned "on" will be turned "off."

The same rule can be seen in a gray level change of 211–212 or 215–216. While the subfield SF11 which was "off" in a representation of the gray level 211 becomes "on" in a representation of the gray level 212, the adjacent subfield SF10 which was "on" becomes "off". Also, while the subfield SF10 which was "off" in a representation of the gray level 215 becomes "on" in a representation of the gray level 216, the adjacent subfield SF9 which was "on" becomes "off". Thus, the combinations are designed such that "on"/"off" subfield distribution changes are interspersed in a time direction of one TV field when the gray level changes, achieving the effects of suppressing moving image false-edge occurrences.

It should be noted that in these cases, since the weighting of a subfield that is turned "on" (SF11 when the gray level changes from 211 to 212, or SF10 when the gray level changes from 215 to 216) is smaller than a highest weighting of a subfield which is currently "on" (SF12 in the gray level 212, or SF11 and SF12 in the gray level 216), it is believed that effects caused by "on"/"off" subfields distribution changes are not as great as in the case of the gray level change from 207 to 208. Accordingly, it is believed that the rule or prioritizing a combination in which a subfield adjacent to a highest-order subfield that is turned "on" becomes "off" is advantages when a weighting of any subfield that is newly turned "on" is larger than a weighting of any currently "on" subfield.

Also, by using combinations which restrict the use of high-order subfields, a total number of subfields that are turned "on" and subfields that are turned "off", and especially a number of high-order subfields, can be minimized for changes in pixel values. By using subfields as such, an "on"/"off" subfield distribution will hardly change, so that the gray level disturbance and moving image false edges can be suppressed.

Specifically, in displaying each of the gray levels 124–127, with the exception of the low-order subfields SF1 and SF2, the subfields SF4, SF5, SF6, SF7, SF8, and SF9 are basically "on", so that the total number of high-order subfields that are turned "on" and that are turned "off" is "0". Thus, combinations which minimizes the total number of subfields that are turned "on" and that are turned "off" are used.

Also, the subfield group of low-order weightings (SF1–SF4) and the subfield group of high-order weightings (SF5–SF12) are respectively arranged in the first and second halves of one TV field. Accordingly, subfields with relatively large weightings will not be turned "on" at disparate times within a TV field. As a result, it is possible to display a sharp image which does not appear blurred.

Verification of Effects of Suppressing Moving Image False-edge Occurrences

Figure 8:
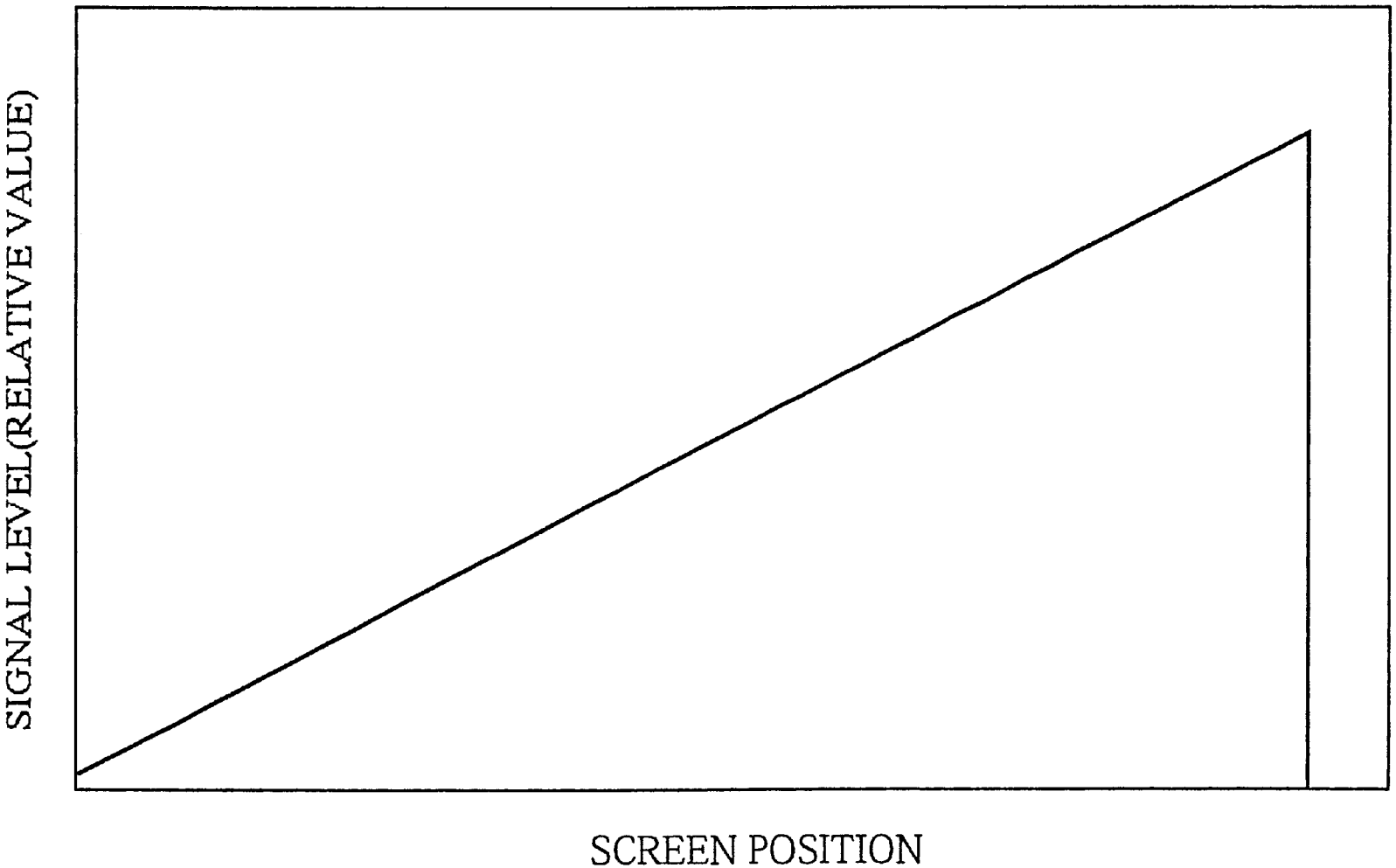
FIGS. 8 10 are characteristic graphs showing simulation experiment results for verifying effect of suppressing the occurrence of moving image false-edge in the image display apparatus.
Figure 9:
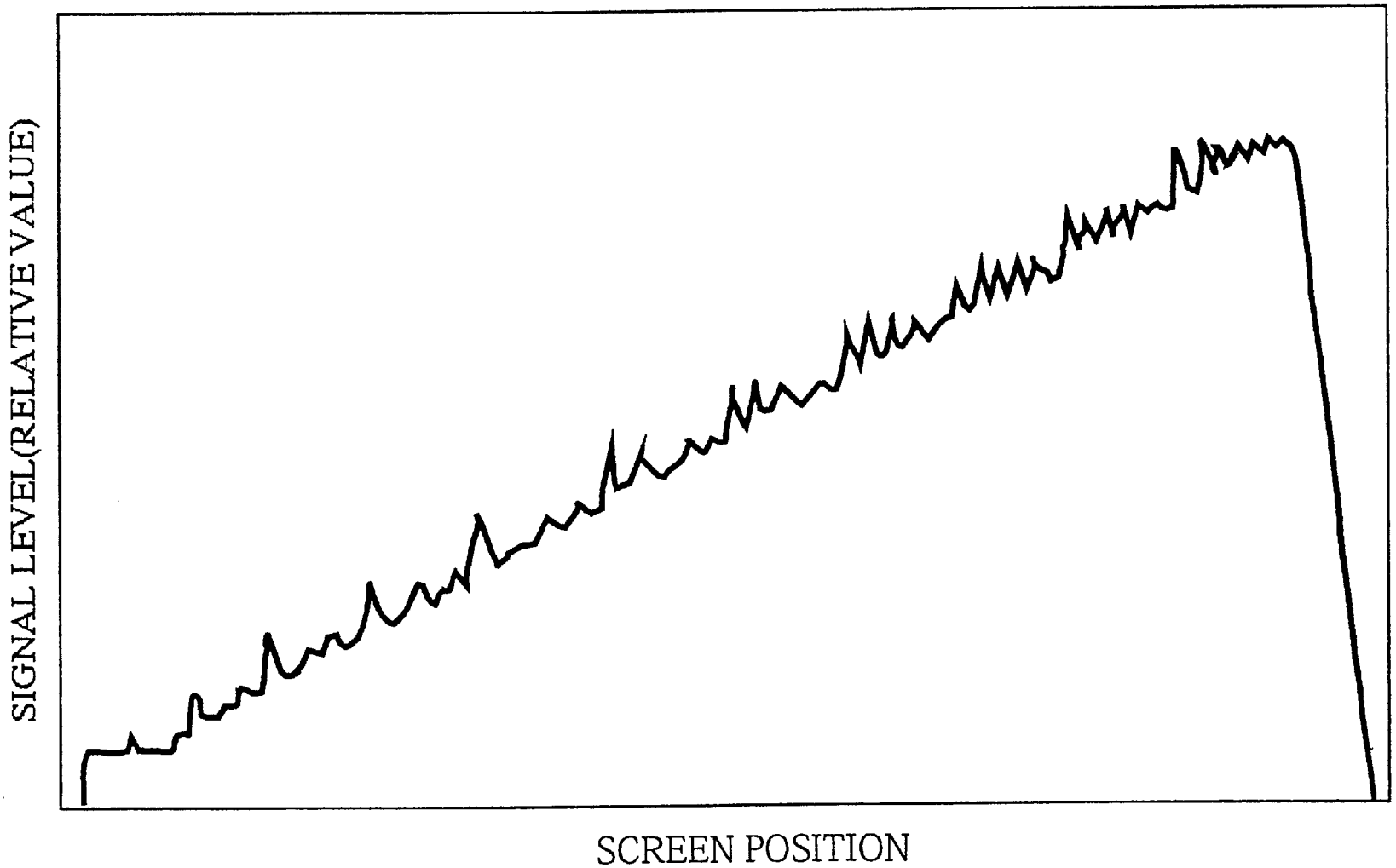
Figure 10:
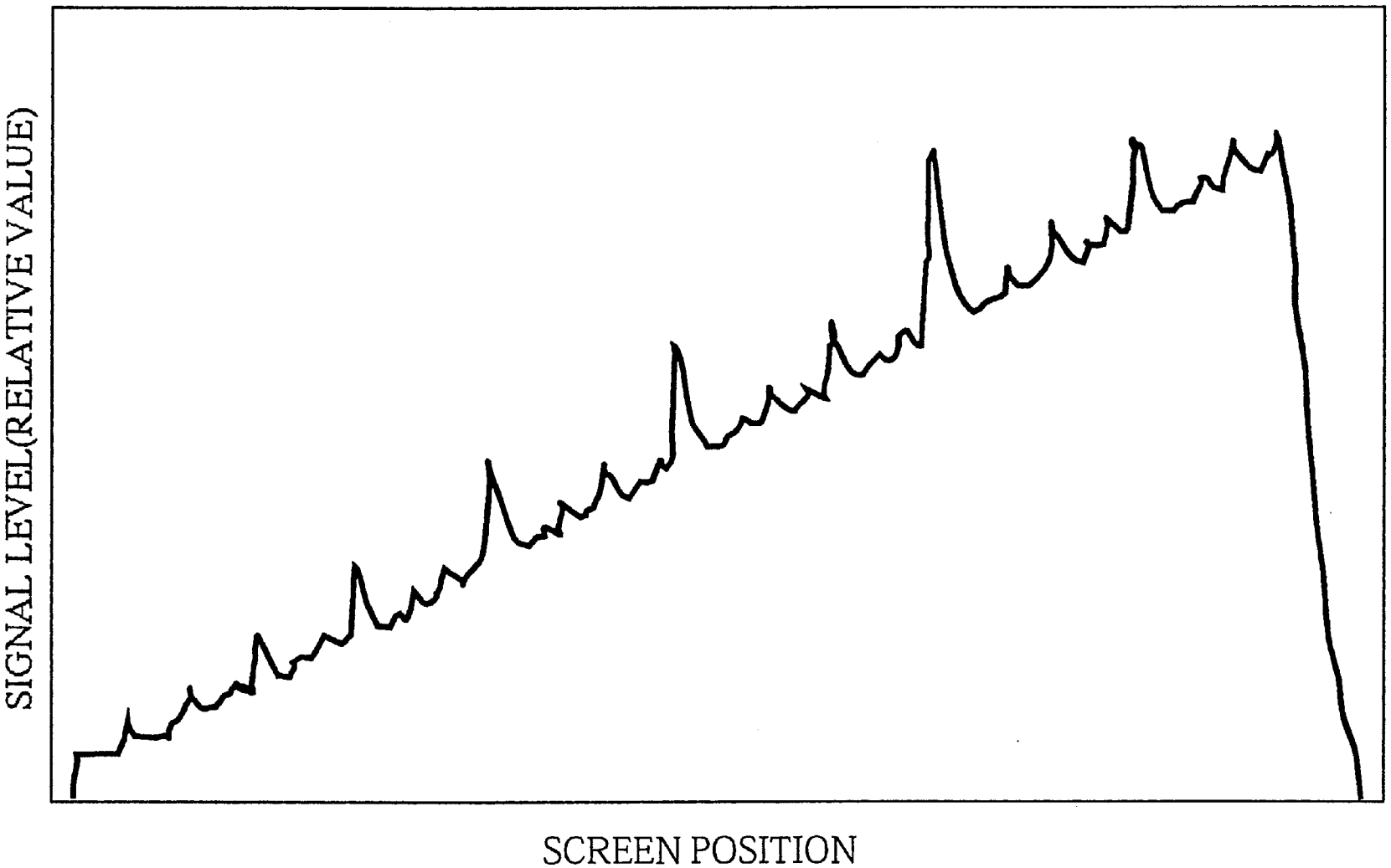

The following is an explanation of effects of the present embodiment of the present invention with reference to FIGS. 8–10. FIG. 8 shows an ideal waveform of an image called ramp waveform, when displaying the image with stepped gray level increases of one level in adjacent pixels. In the figure, the horizontal axis shows a screen position, and the vertical axis shows a relative signal level.

FIG. 9 shows a simulation of the observed waveform when the viewer's eyes follow a display of the image of the ramp waveform shown in FIG. 8 using the present embodiment, wherein fluctuation from the original ramp waveform represents the moving image false-edge occurrence. FIG. 10 shows a simulation of the observed waveform when viewer's eyes follow a display of the same image according to the conventional display method using eight subfields. As clearly seen in the comparison of FIGS. 9 and 10, a peak value of the fluctuation is greatly reduced in the embodiment of the present invention, so that gray level disturbance appeared as moving image false edges are considerably suppressed.

Second Embodiment

The second embodiment is different from the first embodiment in that predetermined gray levels are converted (altered) into different levels before being displayed. The following is an explanation of the difference.

Figure 11:
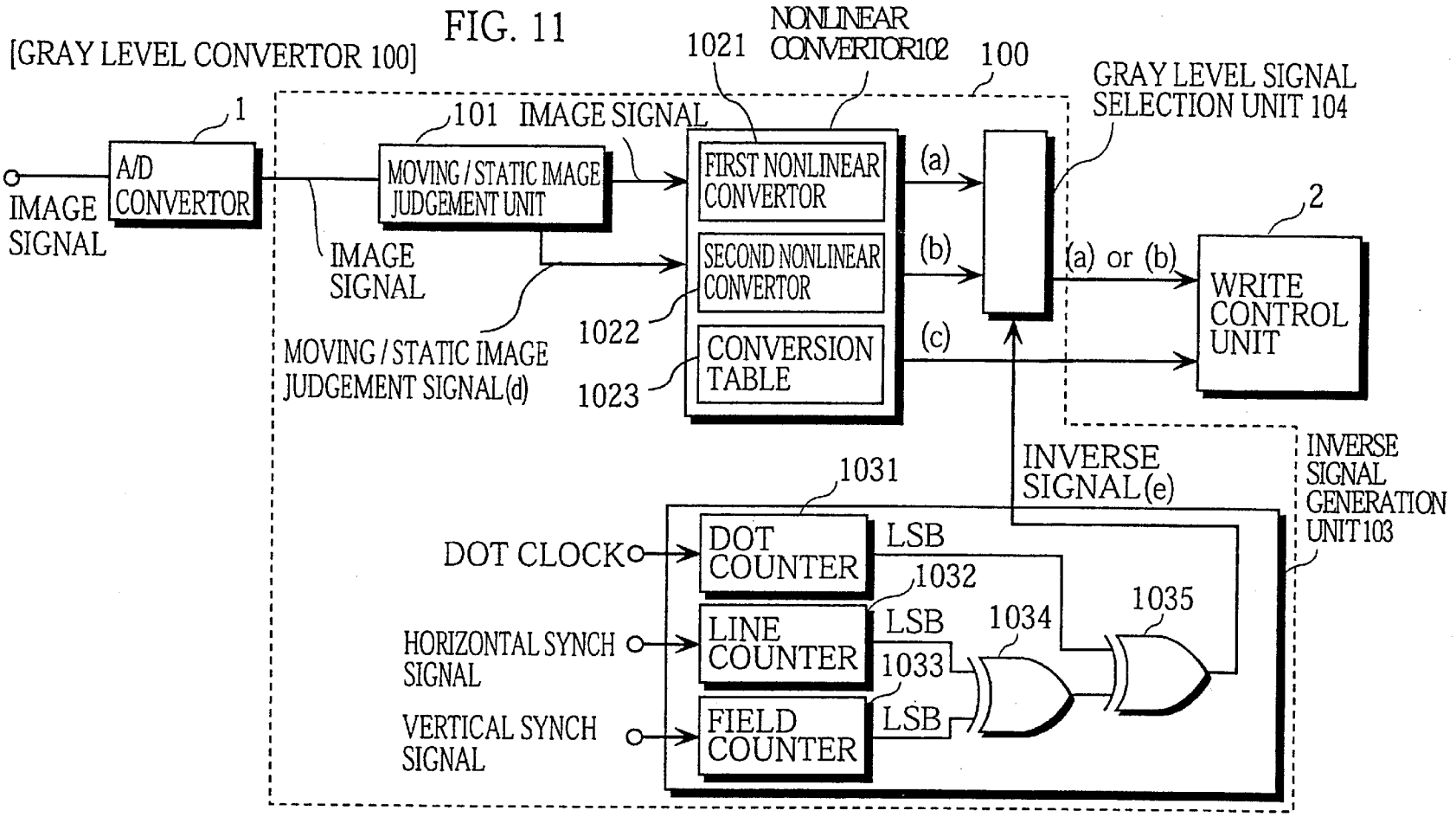
FIG. 11 is a block diagram showing the partial construction of the image display apparatus of the second embodiment.

FIG. 11 is a block diagram showing the construction of the gray level convertor 100 for producing a checkered pattern. As shown in FIG. 11, the gray level convertor 100 is provided between the A/D convertor 1 and the write control unit 2, and includes a moving/static image judgement unit 101, a nonlinear convertor 102, an inverse signal generation unit 103, and a gray level signal selection unit 104.

Figure 12:
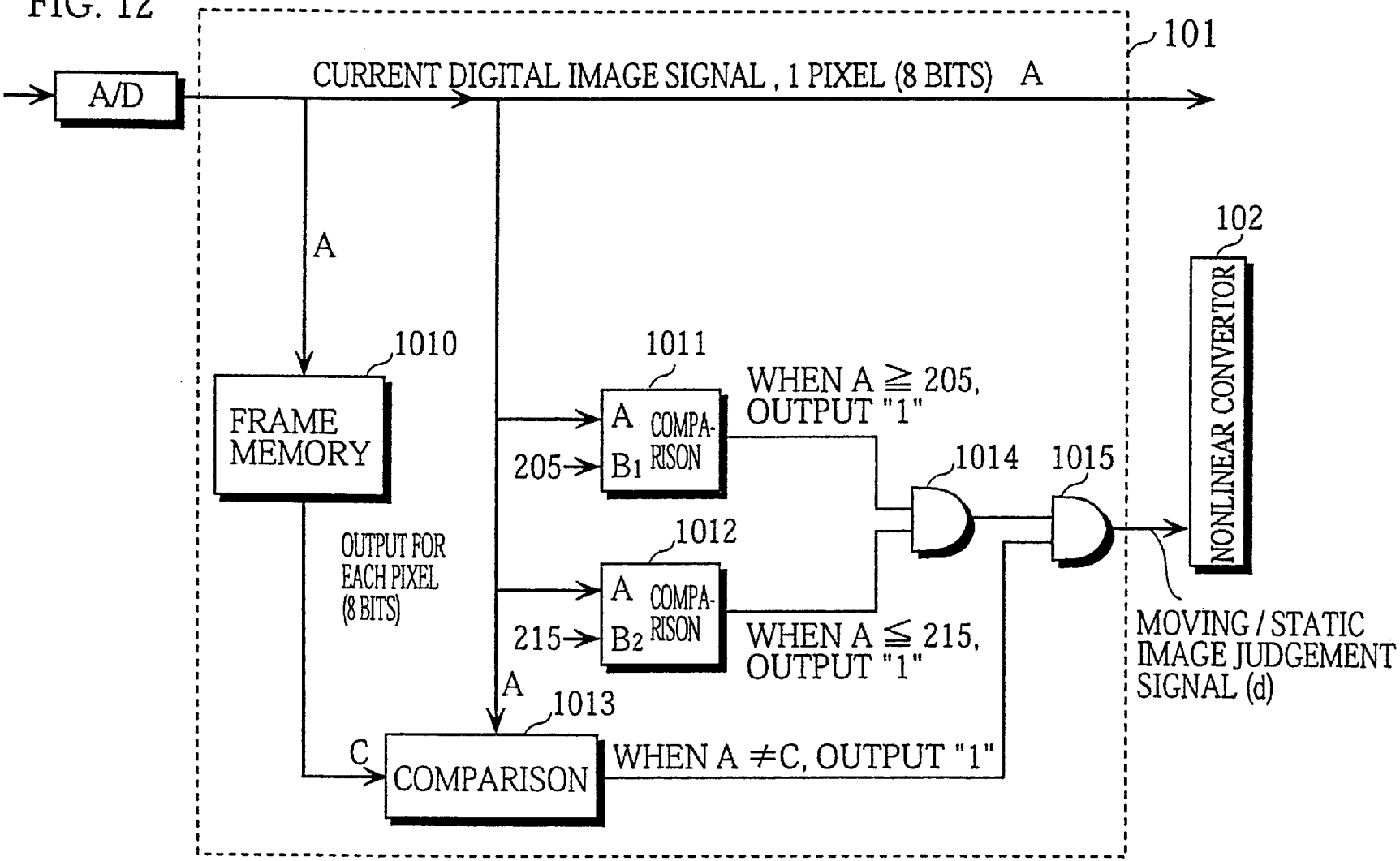
FIG. 12 is a block diagram showing the construction of the moving/static image judgement unit 101 shown in FIG. 11.

As shown in FIG. 12, the moving/static image judgement unit 101 includes a frame memory 1010, three comparison circuits 1011, 1012, and 1013, and two AND circuits 1014 and 1015. The moving/static image judgement unit 101 generates a moving/static image judgement signal (d) showing whether a pixel with a gray level within a predetermined range forms part of a moving image or a static image. The generation of the moving/static image judgement signal (d) is explained later.

As shown in FIG. 11, the nonlinear convertor 102 is equipped with a first nonlinear convertor 1021 and a second nonlinear convertor 1022, and converts an image signal into a higher level in the first nonlinear convertor 1021 and a lower level in the second nonlinear convertor 1022 with reference to a conversion table 1023.

FIG. 13 shows the conversion table 1023. As shown in the figure, the conversion table 1023 shows levels into which image signal levels within a predetermined range (here, 205–215) should be converted. For example, an image signal of the level 208 is to be converted to a higher level (a) and a lower level (b) (216 and 200). The conversion of the level 208 to the level 216 (a) is carried out in the first nonlinear convertor 1021, while the conversion of the level 208 to the level 200 (b) is carried out in the second nonlinear convertor 1022.

The inverse signal generation unit 103 includes a dot counter 1031, a line counter 1032, a field counter 1033, and exclusive OR circuits 1034 and 1035. The dot counter 1031 counts each pixel clock pulse, and is reset by a horizontal synch signal. The line counter 1032 counts each horizontal synch signal, and is reset by a vertical synch signal. The field counter 1033 counts each vertical synch signal. Each LSB (least significant bit) of the dot counter 1031, the line counter 1032, and the field counter 1033 is inputted into the exclusive OR circuits 1034 and 1035, and an inverse signal (e) for each line, each pixel, and each TV field is generated.

The gray level signal selection unit 104 selects one out of two image signals (a) and (b) which have been produced in the nonlinear convertor 102 based on the inverse signal (e), and outputs the selected signal to the write control unit 2.

Generation of Moving/Static Image Judgement Signal

A moving/static image judgement signal (d) is generated in the moving/static image judgement unit 101 by the following processing. The frame memory 1010 stores all image signals of an immediately preceding frame, of which an image signal C of the same pixel as an image signal A of a present frame is outputted to the comparison circuit 1013 to compare A and C. When $A \neq C$, "1" is outputted from the comparison circuit 1013. Otherwise, "0" is outputted.

The image signal A is also compared with a value B1 (here, 205) in the comparison circuit 1011. When $A \geqq 205$, "1" is outputted. Otherwise, "0" is outputted. The image signal A is also compared with a value B2 (here, 215) in the comparison circuit 1012. When $A \leqq 215$, "1" is outputted. Otherwise, "0" is outputted.

Values outputted from the comparison circuits 1011 and 1012 are inputted into the AND circuit 1014. When both values are "1", "1" is outputted. Values outputted from the AND circuit 1014 and the comparison circuit 1013 are inputted into the AND circuit 1015. When both values are "1", that is, when $A \neq C$ and $205 \leqq A \leqq 215$, "1" is outputted as a moving/static image judgement signal (d). Otherwise, "0" is outputted as a moving/static image judgement signal (d).

When the moving/static image judgement signal (d) is "1", this means that the present image signal A of one pixel is different from the image signal C of the same pixel of the immediately preceding frame and that the value of the present image signal A is within the range of 205–215. That is to say, the pixel forms part of a high luminance area of a moving image. This comparison processing is carried out for each pixel of the present frame, wherein judgement is performed as to whether each pixel constitutes a moving image or a static image, and whether its signal level is within the range of 205–215.

As the frame memory 1010 which is provided with a capacity for storing image signals of two frames, a 2-port frame memory is used which can read out image signals of an immediately preceding frame while writing image signals of a present frame as comparison data which will be used when displaying a next frame.

Generation of Checkered Pattern

When the moving/static image judgement signal (d) generated in the above processing is "1", the present image signal of the pixel is converted into two values (a) and (b) in the respective first and second nonlinear convertors 1021 and 1022, and these values are then outputted to the gray level signal selection unit 104. In synchronization with the inverse signal (e), the value (a) is selected with the inverse signal (e) is "1", while the value (b) is selected when the inverse signal (e) is "0". When the moving/static image judgement signal (d) is "0", it means either that the pixel constitutes a static image or that the pixel constitutes a moving image but its signal level is not within the range of 205–215. Accordingly, the image signal is not converted but directly outputted to the write control unit 2.

After the same conversion processing of predetermined image signals has been carried out for every pixel, each image signal is converted into subfield information, which is written into the frame memory 3 and then read to the PDP 5. Thus, pixels with the gray levels 205–215 are displayed in a checkered pattern of (a), (b), (a), (b), . . . .

Figure 14:
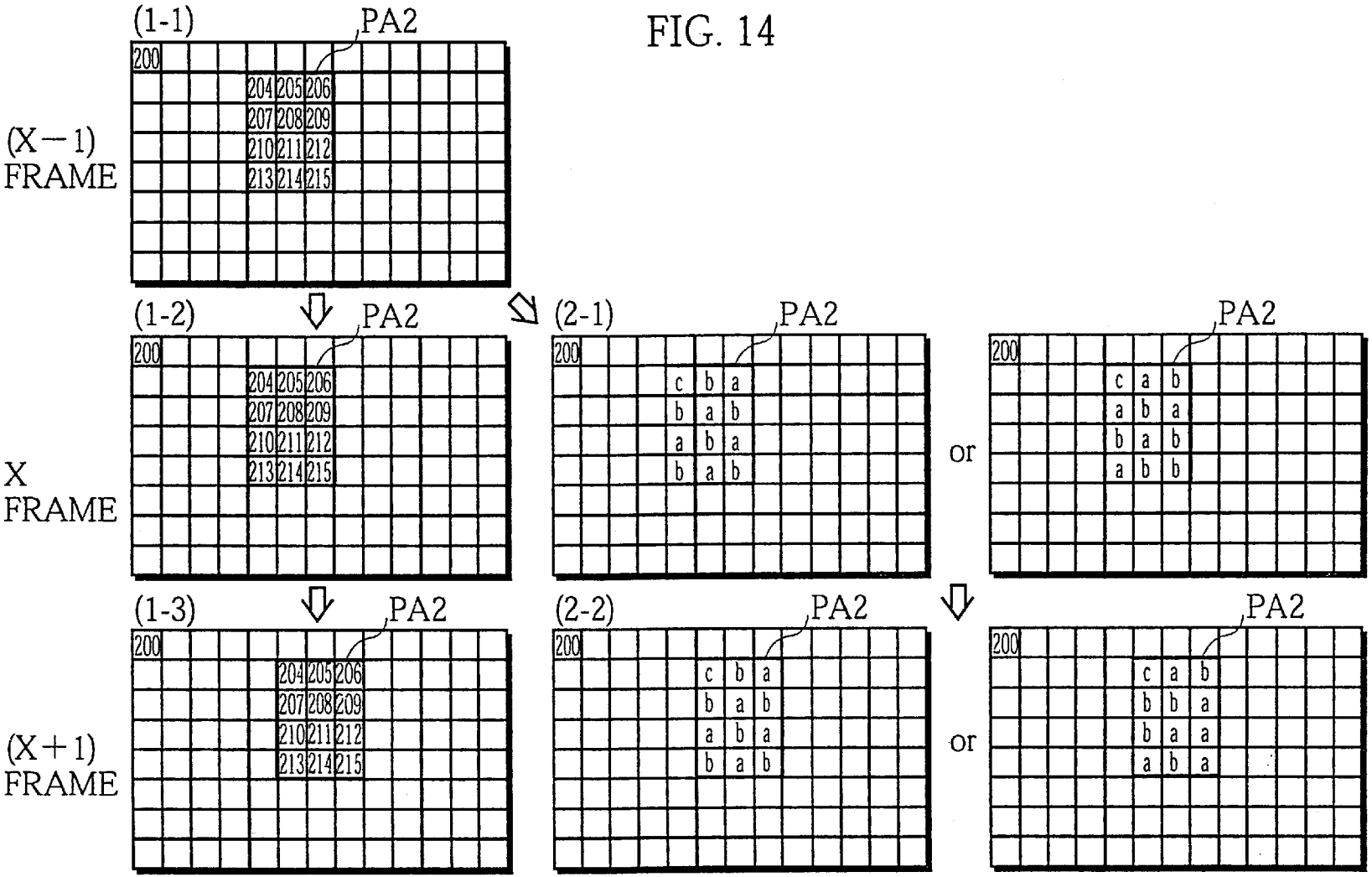
FIG. 14 is a pattern figure showing specific gray-level displays in the second embodiment.

The following is a more specific explanation with reference to FIG. 14. FIG 14 is a pattern figure showing several types of PDP display on which a picture pattern PA2 composed of twelve pixels with the gray levels 204–215 is displayed. In FIG. 14, the area (1-1) shows the picture pattern PA2 of the "(x−1)"th frame which was displayed immediately before a present frame. The area (1-2) shows the picture pattern PA2 of the present "x"th frame which is being displayed. The area (1-3) shows the picture pattern PA2 of the "x+1)"th frame which is to be displayed next. In this example, when the "(x−1)"th frame changes to the "x"th frame and then to the "(x+1)"th frame, the picture pattern PA2 moves by a predetermined number of pixels. To simplify the explanation, gray levels of all other pixels on the screen which are not included in the picture pattern PA2 are set at 200 which is lower than any gray levels of the twelve pixels in the picture pattern PA2.

If the present frame is displayed without conversion of the gray levels, the display appears as shown in the area (1-2). However, as all pixels with the gray levels 205–215 constitute a moving image in this example, these levels are converted into either a pattern (a), (b), (a), (b), . . . or a pattern (b), (a), (b), (a), . . . . As a result, the resulting display appears as shown in the area (2-1). The pixel with the level 204 constitutes the moving image but is not within the range of 205–215, so that the unconverted level (c) is displayed. Thus, pixels which constitute a moving image and whose levels are within a predetermined range are displayed in the checkered pattern.

Also, if the next "(x+1)"th frame, after the parallel movement of the picture pattern PA2 from the "x"th frame, is displayed without conversion of the gray levels, the display appears as shown in the area (1-3). However, since the picture pattern PA2 of the "(x+1)"th frame is a moving image which includes pixels with the gray levels 205–215, the levels of these pixels are converted into either the pattern (b), (a), (b), (a), . . . or the pattern (a), (b), (a), (b), . . . As a result, a checkered pattern shown in the area (2 2) is displayed. These checkered patterns are designed such that a signal is inverted in each pixel, each line, and each field (that is, a picture pattern has a signal which alternates in each pixel, each line, and each field). Accordingly, the picture pattern PA2 of the "(x+1)"th frame is determined according to the distance the picture pattern PA2 has moved from the "x"th frame to the "(x+1)"th frame.

Such image displays in a checkered pattern are used for the following reason.

When a moving image is displayed using the subfield combinations of the first embodiment, gray level disturbance can still occur depending on eyes' direction. As shown in FIG. 3, a gray level of the dashed arrow 2 is observed to be approximately "0", so that there is a possibility of the false-edge occurrence. This will not be a problem in a relatively low gray level area, as the low luminance in the background makes the false-edges unnoticeable. However, in a high gray level area centered on 208, the false-edges will be more noticeable due to the high luminance in the background. Thus, when a high-order subfield which has been "off" in an one-level lower gray scale is turned "on", even if low-order subfields are "on" while a subfield adjacent to the high-order subfield that is turned "on" is turned "off" in order to intersperse "on"/"off" subfield distribution changes in a time direction of one TV field as in the first embodiment, it is unavoidable that an "on"/"off" subfield distribution changes to some degree as at least one subfield that was "on" should be turned "off.

To further suppress the changes in "on"/"off" subfield distribution, the gray level 208 is converted into a plurality of higher or lower gray levels to make the gray level 208 and its adjacent gray levels nonlinear and to avoid the subfield (SF11) adjacent to the subfield (SF12) which is turned "on" from becoming "off".

Also, to prevent the pixels with the converted gray levels from appearing noticeable, a checkered pattern is used in which a gray level is alternately inverted to a higher or lower level in each adjacent pixel with a gray level close to the gray level 208.

Figure 15:
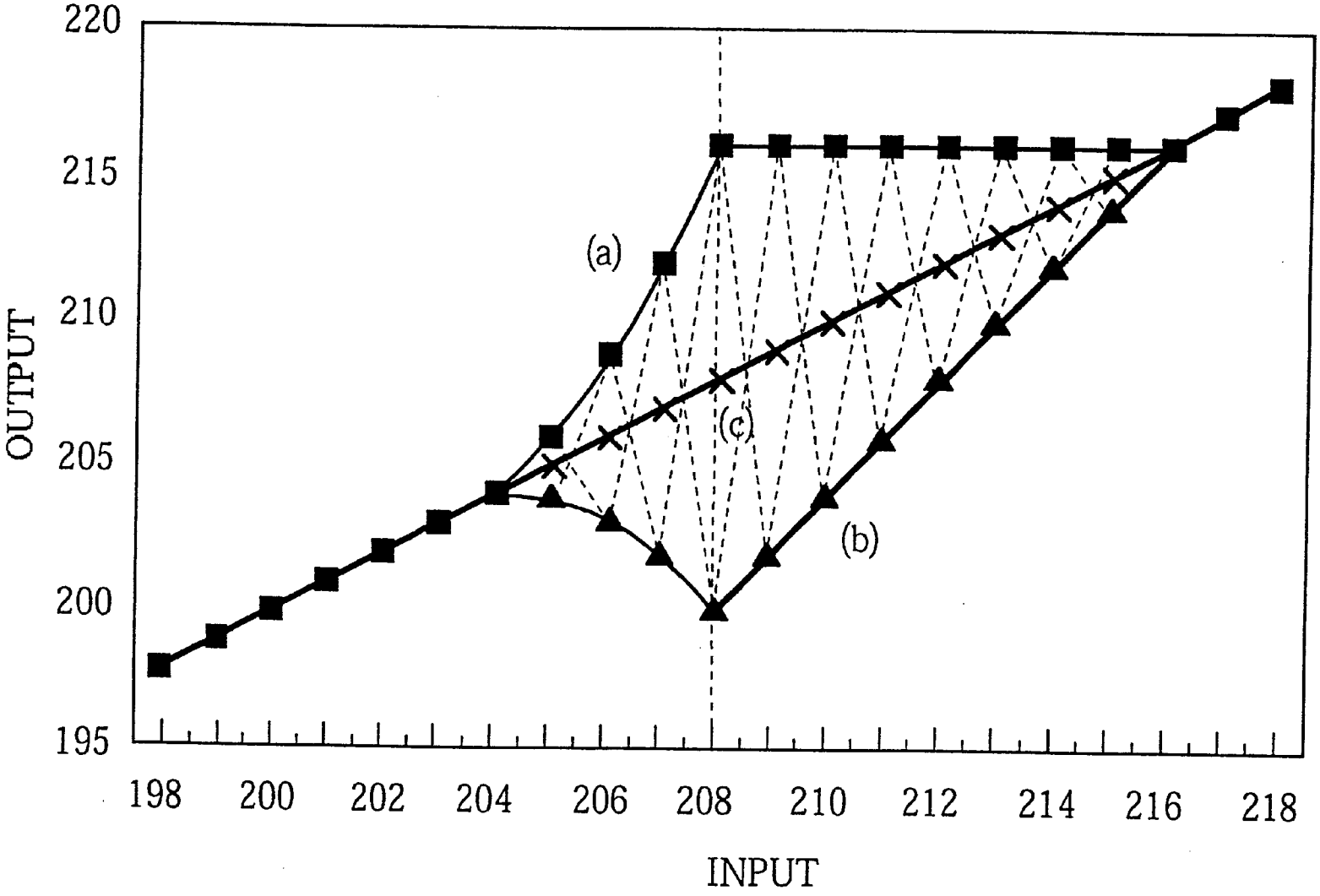
FIG. 15 is a characteristic graph showing average gray level outputs when displaying an image by converting gray levels.
Figure 18:
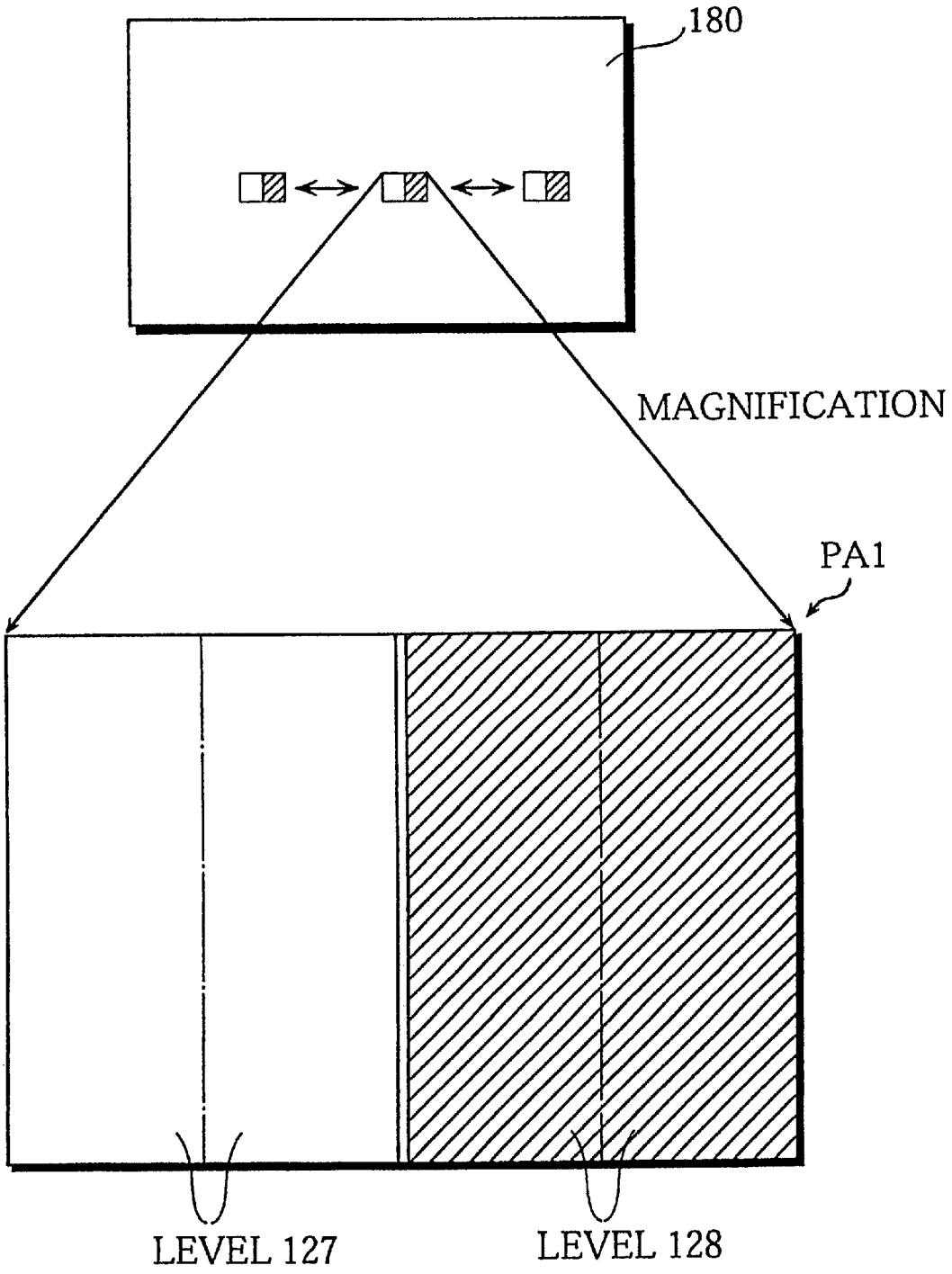
FIG. 18 PRIOR ART
FIG. 18 is a figure for explaining a conventional image display apparatus, showing movement of a predetermined picture pattern by two pixels.
Figure 19:
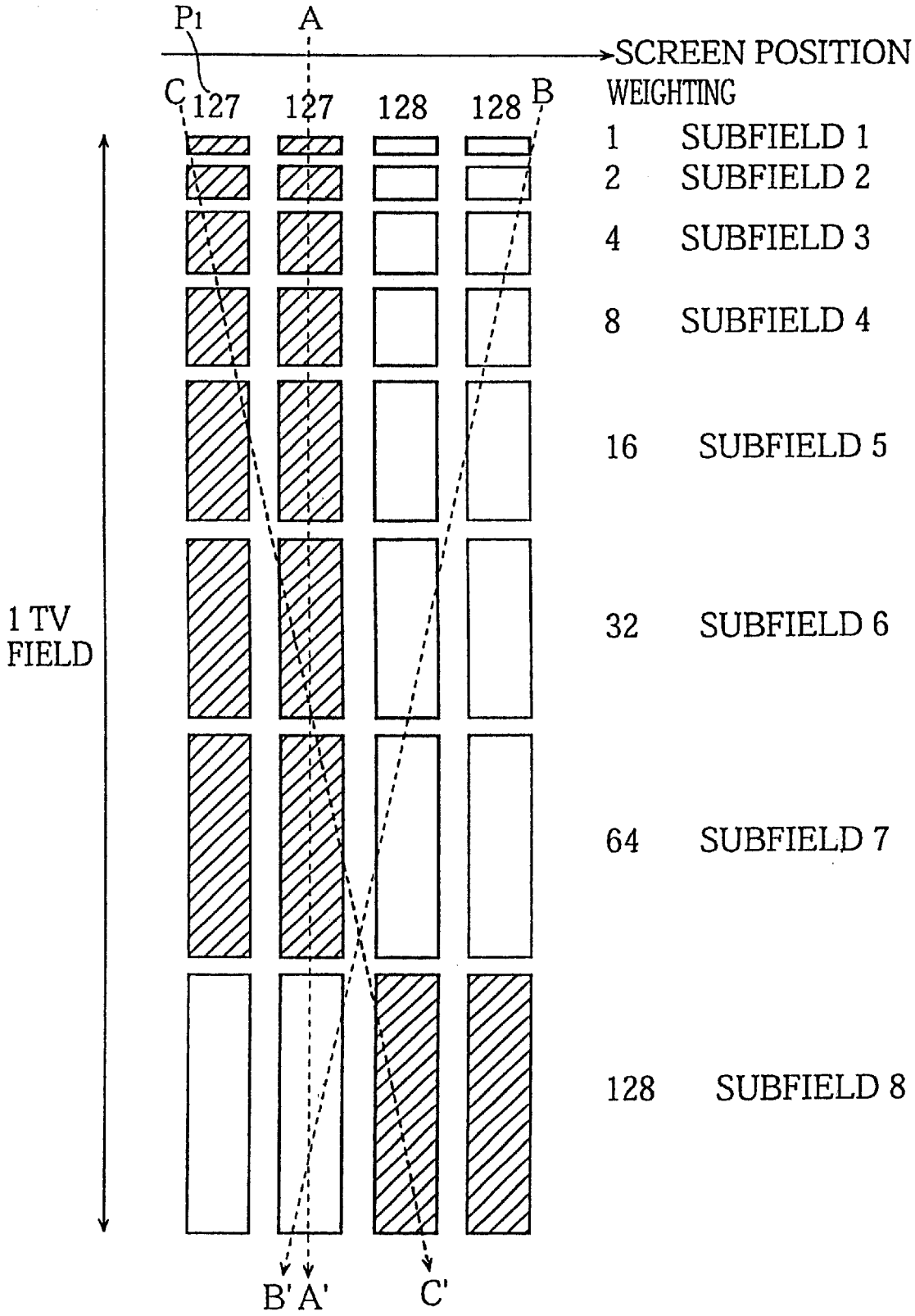
FIG. 19 PRIOR ART
FIG. 19 shows how the viewer's eyes follow the movement of the picture pattern.
Figure 20:
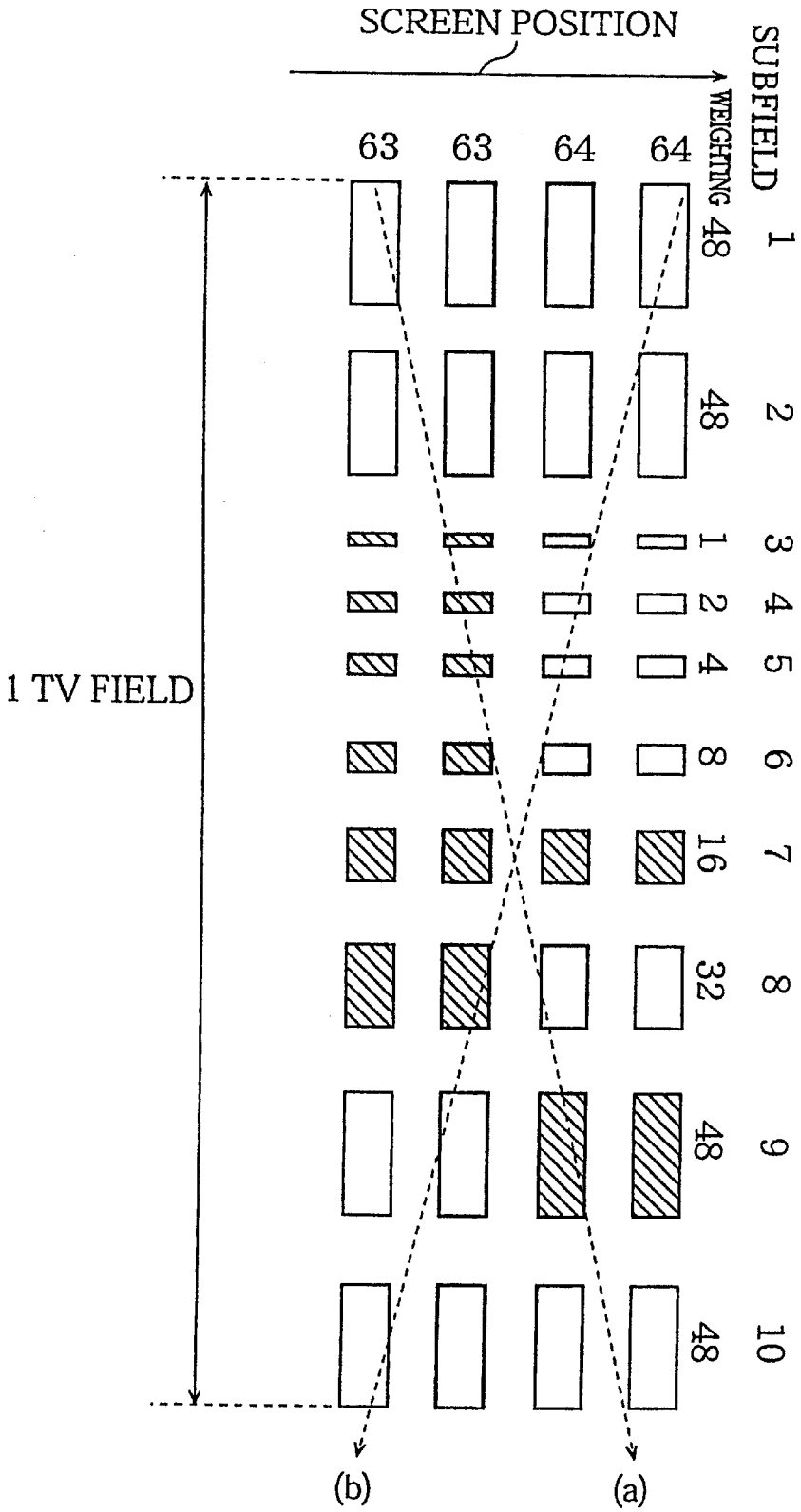
FIG. 20 PRIOR ART
FIG. 20 is a figure for explaining another conventional image display apparatus, corresponding to FIG. 19.

By displaying the adjacent pixels with alternately inverted gray levels, the effects of converting the gray level 208 to (a) or (b) can be offset by visual effects. As shown in FIG. 15 in which the horizontal axis shows an input value of an image signal and the vertical axis shows an output value of the image signal, linearity of the image which changes from the level 205 to the level 215 is maintained (shown by the line (c)) in order not to affect the average gray level of the image.

Also, since the checkered pattern of the "(x+1)"th frame is determined by the moving distance and direction of the picture pattern PA2 from the "x"th frame, the picture pattern PA2 of the "(x+1)"th frame may be displayed as an inverse pattern of the checkered pattern of the "x"th frame. When this happens, it means that each pixel which constitutes the moving image has a gray level which is inverted for each frame. That is to say, the same pixel in two consecutive frames has inverse gray levels of either (a)→(b) or (b)→(a). Accordingly, when focusing on each pixel with a particular gray level, linearity in a time series is maintained. When the linearity in the time series can be maintained in pixels, the average image quality will be improved.

Thus, as values (a) and (b) to which an image signal level is to be converted, appropriate values are selected such that the linearity can be maintained in both space and time.

On the other hand, a static image is displayed using the original image signal level (c) regardless of a value of the inverse signal (e). By doing so, a number of occurrences of a side effect that a checkered pattern appears on the screen is reduced, without reducing the effect of suppressing the occurrence of moving image false edges. For gray levels which are not included in the gray level range centered on 208, the moving image false-edges can be eliminated by the first embodiment. Accordingly, an area which is displayed by non-linearity converting gray levels is limited to the gray level area centered on the gray level 208. This also contributes to the reduction of the side effect that the checkered pattern is observed.

Modified Examples

The following are the modified examples of the above embodiments.

① Though twelve subfields are respectively assigned weightings of 1, 2, 4, 8, 12, 20, 24, 32, 36, 40, and 48 in the above embodiments, the present invention is not limited to such. As long as the characteristics described above are satisfied, other weightings can be assigned, such as 1, 2, 4, 8, 12, 16, 24, 28, 32, 36, 44, and 48.

Also, the total number of subfields can be set at eleven, with these subfields being assigned weightings of 1, 2, 4, 8, 16, 24, 32, 36, 40, 44, and 48 respectively.

Also, the total number of subfields can be set at ten, with these subfields being assigned weightings of 1, 2, 4, 8, 16, 24, 32, 48, 56, and 64 respectively.

Also, the total number of subfields can be set at nine, with these subfields being assigned weightings of 1, 2, 4, 8, 16, 32, 48, 64, and 80 respectively.

In fact, the larger the number of subfields, the smaller the difference in luminance weightings will be, so that changes in an "on"/"off" subfield distribution will be reduced. Accordingly, the effect of suppressing the moving image false-edges are more prominent with a large number of subfields than with a small number of subfields.

Weightings may also be assigned in descending order. Here, a weighting is assigned to each subfield such that subfields are arranged in a substantially increasing or decreasing order of the weighting. However, subfields with the low-order weightings of 1, 2, 4, and 8 may be arranged irregularly, as this will not affect the effect of suppressing the moving image false-edges.

An example of the subfield conversion table 210 when the subfields are arranged in decreasing order of the weighting is shown in FIG. 16.

② As for the subfield arrangement, after the subfields which have been assigned the respective weightings in ascending order are divided into two subfield groups based on a predetermined weighting, it is possible to arrange the subfields so that one subfield which belongs to the subfield group of high-order weightings is sandwiched between subfields of low-order weightings. In the first embodiment, for instance, subfields are divided into the first subfield group composed of four subfields which each have a weighting equal to or smaller than 8 (weightings of 1, 2, 4, and 8) and the second subfield group composed of eight subfields which each have a weighting equal to or larger than 12 (weightings of 12, 20, 24, 28, 32, 36, 40, and 48). Here, one subfield in the second subfield group (the subfield with a weighting 24) may be sandwiched between subfields of the first group. As a result, the subfield arrangement can be described using weightings as: 1, 2, 4, 24, 8, 12, 20, 28, 32, 36, 40, 48.

When all of the subfields are arranged in ascending order of time as in the first embodiment, in an area where a gray level of a digital image signal changes from 47 to 48, for example, using a subfield of a relatively high-order weighting is unavoidable. As a result, even if a subfield adjacent to a highest-order subfield that is "on" is turned "off", gray level disturbance still appears when eyes follow the direction shown by the dashed arrow 3 in FIG. 3, thus leaving more room for improvement.

Here, by arranging the subfields as described above, the luminance changes can be further balanced as shown below. As a result, changes of an "on"/"off" subfield distribution will be further reduced, so that the occurrence of moving image false-edges can be suppressed.

Subfield weighting: 1, 2, 4, 24, 8, 12, 20, 28, 32, 36, 40, 48 level 47: 1 1 1 0 1 1 1 0 0 0 0 0 level 48: 0 0 1 1 1 1 0 0 0 0 0 0

③ In the above embodiments,"on" subfields are selected for each gray level so that the use of subfields with high-order weightings is minimized, though such a selection method can be limited to a high gray level area where the moving image false-edges tend to appear.

④ The method of displaying a checkered pattern by alternately inverting a gray level for each pixel and each line is preferably used in a gray level area where the moving image false-edges tend to appear despite the improvements made by the first embodiment, although the method may equally be applied to other cases, such as a case when eight conventional subfields with weightings of 1, 2, 4, 8, 16, 32, 64, and 128 (weightings assigned according to powers of the number two) are used.

For example, the same effect can be achieved by alternately converting a gray level within a predetermined range shown in FIG. 17 into a higher gray level or a lower gray level.

⑤ Though the conversion of an input signal into either the value (a) or the value (b) is carried out before the signal is converted to subfield information, the conversion may also be carried out by comparing, after the signal is converted to the subfield information, the subfield information with image signal data of an immediately preceding frame which has been written in a memory area of the frame memory 3.

⑥ Though the above embodiments have been explained for a PDP apparatus as an image display apparatus, the present invention is not limited to such, since any image display apparatus can be used which uses a display panel for displaying gray levels by time integration of a plurality of illuminations.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image display apparatus, wherein one TV field is composed of a plurality of subfields which have different luminance weightings and are arranged in order of time, for displaying an image of the TV field in a multi-level gray scale by selecting, for each pixel, an "on"/"off" subfield combination in which subfields that are "on" and subfields that are "off" are selected from the plurality of subfields, the image display apparatus being characterized by that the luminance weightings of the plurality of subfields are determined so that:

the plurality of subfields are arranged in any of a substantially increasing order and a substantially decreasing order of the luminance weightings; and the plurality of subfields are divided into a first group of subfields with luminance weightings smaller than a predetermined luminance weighting and a second group of subfields which are other than the subfields of the first group, wherein the luminance weightings of the subfields of the first group are in a geometric series, and luminance weightings of the subfields of the second group are in a substantially arithmetic series.

2. The image display apparatus of claim 1, wherein in order to display a gray level, an "on"/"off" subfield combination in which subfields with large luminance weightings are "off" is selected.

3. The image display apparatus of claim 2, wherein one of the following arrangements is used when a total number of gray levels is 256:

(1) the plurality of subfields are composed of nine subfields with a luminance weighting ratio of 1:2:4:8:16:32:48:64:80;

(2) the plurality of subfields are composed of ten subfields with the luminance weighting ratio of 1:2:4:8:16:24:32:48:56:64;

(3) the plurality of subfields are composed of eleven subfields with the luminance weighting ratio of 1:2:4:8:16:24:32:36:40:44:48;

(4) the plurality of subfields are composed of twelve subfields with the luminance weighting ratio of 1:2:4:8:12:20:24:28:32:36:40:48; and (5) the plurality of subfields are composed of twelve subfields with the luminance weighting ratio of 1:2:4:8:12:16:24:28:32:36:44:48.

4. The image display apparatus of claim 1, wherein when an "on"/"off" subfield combination is selected from possible "on"/"off" subfield combinations for displaying a present gray level which is one level higher than a gray level that was displayed immediately before the present gray level, an "on"/"off" subfield combination in which a subfield adjacent to a subfield with a largest weighting that is turned "on" becomes "off" is given priority.

5. An image display apparatus, wherein one TV field is composed of a plurality of subfields which have respective luminance weightings and are arranged in order of time, for displaying an image of the TV field by selecting, for each pixel, an "on"/"off" subfield combination in which subfields that are "on" are selected from the plurality of subfields and by illuminating each pixel at a luminance which corresponds to a total value of luminance weightings of the subfields that are "on", the image display apparatus being characterized by that an assignment of the respective luminance weightings to the plurality of subfields satisfies a condition (a), the condition (a) being that:

a total value of the respective luminance weightings of the plurality of subfields which compose the TV field corresponds to a highest gray level, wherein the respective luminance weightings of the plurality of subfields which compose the TV field are each different; and a number of the plurality of subfields which compose the TV field is determined such that, regarding at least one gray level, at least two "on"/"off" subfield combinations are possible for displaying the gray level, wherein an arrangement of the plurality of subfields is determined so as to satisfy any of the following orders:

(b) a substantially increasing order of the respective luminance weightings;

(c) a substantially decreasing order of the respective luminance weightings; and (d) a substantially increasing and then decreasing order of the respective luminance weightings.

6. The image display apparatus of claim 5, wherein an "on"/"off" subfield combination is selected which satisfies the following condition:

when there are at least two possible "on"/"off" subfield combinations for displaying a gray level, an "on"/"off" subfield combination in which a number of subfields that are "on" is a largest number is used for displaying the gray level.

7. The image display apparatus of claim 5, wherein when a gray level of at least one pixel which constitutes an image to be displayed satisfies a predetermined condition, the gray level of the pixel is converted to at least two different gray levels whose average value is equal to the gray level of the pixel, the converted gray levels then being alternately displayed in at least two consecutive TV fields.

8. An image display apparatus, wherein one TV field is composed of M subfields which have respective luminance weightings and are arranged in order of time, for displaying an image of the TV field in N gray levels by selecting, for each pixel, an "on"/"off" subfield combination in which subfields that are "on" are selected from the M subfields and by illuminating each pixel at a luminance which corresponds to a total value of luminance weightings of the subfields that are "on", the image display apparatus being characterized by that a total value of the respective luminance weightings of M subfields, the respective luminance weightings being each different, is"N−1", wherein a formula "M>(log N/log 2)" is satisfied, wherein M and N are natural numbers, and wherein the M subfields are arranged so as to satisfy any of the following orders:

(a) a substantially increasing order of the respective luminance weightings;

(b) a substantially decreasing order of the respective luminance weightings; and (c) a substantially increasing and then decreasing order of the respective luminance weightings, and wherein when there are at least two possible "on"/"off" subfield combinations in which subfields that are "on" are selected from the M subfields for displaying a gray level, an "on"/"off" subfield combination in which a number of subfields that are "on" is a largest number is used for displaying the gray level.

9. The image display apparatus of claim 8, wherein the respective luminance weightings of the M subfields are in a substantially arithmetic series.

10. The image display apparatus of claim 9, wherein N is 256, and wherein the respective luminance weightings of the M subfields include luminance weightings of 1, 2, 4, and 8, and luminance weightings larger than 8 which are in a sequence where consecutive luminance weightings differ by one of 4, 8, and 16.

11. The image display apparatus of claim 10, wherein one of the following arrangements is used:

(1) the M subfields are composed of nine subfields with a luminance weighting ratio of 1:2:4:8:16:32:48:64:80;

(2) the M subfields are composed of ten subfields with the luminance weighting ratio of 1:2:4:8:16:24:32:48:56:64;

(3) the M subfields are composed of eleven subfields with the luminance weighting ratio of 1:2:4:8:16:24:32:36:40:44:48;

(4) the M subfields are composed of twelve subfields with the luminance weighting ratio of 1:2:4:8:12:20:24:28:32:36:40:48; and (5) the M subfields are composed of twelve subfields with the luminance weighting ratio of 1:2:4:8:12:16:24:28:32:36:44:48.

12. An image display apparatus, wherein one TV field is composed of M subfields which have respective luminance weightings and are arranged in order of time, for displaying an image of the TV field in N gray levels by selecting, for each pixel, an "on"/"off" subfield combination in which subfields that are "on" are selected from the M subfields and by illuminating each pixel at a luminance which corresponds to a total value of luminance weightings of the subfields that are "on", the image display apparatus being characterized by that a total value of the respective luminance weightings of the M subfields, the respective luminance weightings being each different, is "N−1", wherein a formula "M>(log N/log 2)" is satisfied, wherein M and N are natural numbers, and wherein the M subfields are arranged so as to satisfy any of the following orders:

(a) a substantially increasing order of the respective luminance weightings;

(b) a substantially decreasing order of the respective luminance weightings; and (c) a substantially increasing and then decreasing order of the respective luminance weightings, and wherein when there are at least two possible "on"/"off" subfield combinations in which subfields that are "on" are selected from the M subfields for displaying a gray level, an "on"/"off" subfield combination in which subfields with large luminance weightings are "off" is used for displaying the gray level.

13. A gray level display method in an image display apparatus, wherein one TV field is composed of a plurality of subfields which have different luminance weightings and are arranged in order of time, for displaying an image of the TV field in a multi-level gray scale by selecting, for each pixel, an "on"/"off" subfield combination in which subfields that are "on" and subfields that are "off" are selected from the plurality of subfields, that are specified by the following conditions:

(a) the plurality of subfields are arranged in any of a substantially increasing order and a substantially decreasing order of the luminance weightings; and (b) the plurality of subfields are divided into a first group of subfields with luminance weightings smaller than a predetermined luminance weighting and a second group of subfields which are other than the subfields of the first group, wherein the luminance weightings of the subfields of the first group are in a geometric series, and luminance weightings of the subfields of the second group are in a substantially arithmetic series, the gray level display method comprising:

a step for selecting, when there are a plurality of possible "on"/"off" subfield combinations for displaying a gray level using the plurality of subfields, an "on"/"off" subfield combination in which subfields with large luminance weightings are "off" and subfields with small luminance weightings are "on".

14. The gray level display method of claim 13, wherein one of the following arrangements is used when a total number of gray levels is 256:

(1) the plurality of subfields are composed of nine subfields with a luminance weighting ratio of 1:2:4:8:16:32:48:64:80;

(2) the plurality of subfields are composed of ten subfields with the luminance weighting ratio of 1:2:4:8:16:24:32:48:56:64;

(3) the plurality of subfields are composed of eleven subfields with the luminance weighting ratio of 1:2:4:8:16:24:32:36:40:44:48;

(4) the plurality of subfields are composed of twelve subfields with the luminance weighting ratio of 1:2:4:8:12:20:24:28:32:36:40:48; and (5) the plurality of subfields are composed of twelve subfields with the luminance weighting ratio of 1:2:4:8:12:16:24:28:32:36:44:48.

15. A gray level display method in an image display apparatus, wherein one TV field is composed of a plurality of subfields which have respective luminance weightings and are arranged in order of time, for displaying an image of the TV field by selecting, for each pixel, an "on"/"off" subfield combination in which subfields that are "on" are selected from the plurality of subfields and by illuminating each pixel at a luminance which corresponds to a total value of luminance weightings of the subfields that are "on", wherein an assignment of the respective luminance weightings to the plurality of subfields satisfies the following conditions:

(a) a total value of the respective luminance weightings of the plurality of subfields which compose the TV field corresponds to a highest gray level;

(b) the respective luminance weightings of the plurality of subfields which compose the TV field are each different; and (c) a number of the plurality of subfields which compose the TV field is determined such that, regarding at least one gray level, at least two "on"/"off" subfield combinations are possible for displaying the gray level, wherein the plurality of subfields are arranged in the TV field so as to satisfy any of the following orders:

(a) a substantially increasing order of the respective luminance weightings;

(b) a substantially decreasing order of the respective luminance weightings; and (c) a substantially increasing and then decreasing order of the respective luminance weightings, and the gray level display method comprising a step for selecting, when there are at least two possible "on"/"off" subfield combinations for displaying a gray level, an "on"/"off" subfield combination in which a number of subfields that are "on" is a largest of the possible "on"/"off" subfield combination.

16. The gray level display method of claim 15, further comprising a step for converting, when a gray level of at least one pixel which constitutes an image to be displayed satisfies a predetermined condition, the gray level of the pixel to at least two different gray levels whose average value is equal to the gray level of the pixel, so that the converted gray levels are alternatively displayed in at least two consecutive TV fields.

17. A gray level display method in an image display apparatus, wherein one TV field is composed of M subfields which have respective luminance weightings and are arranged in order of time, for displaying an image of the TV field in N gray levels by selecting, for each pixel, an "on"/"off" subfield combination in which subfields that are "on" are selected from the M subfields and by illuminating each pixel at a luminance which corresponds to a total value of luminance weightings of the subfields that are "on", wherein a total value of the respective luminance weightings of the M subfields, the respective luminance weightings being each different, is "N−1", wherein a formula "M>(log N/log 2)" is satisfied, wherein M and N are natural numbers, and wherein the M subfields are arranged so as to satisfy any of the following orders:

(a) a substantially increasing order of the respective luminance weightings;

(b) a substantially decreasing order of the respective luminance weightings; and (c) a substantially increasing and then decreasing order of the respective luminance weightings, the gray level display method comprising a step for selecting, when there are at least two possible "on"/"off" subfield combinations in which subfields that are "on" are selected from the M subfields for displaying a gray level, an "on"/"off" subfield combination in which a number of subfields that are "on" is the largest of the possible "on"/"off" subfield combinations.

18. An image display apparatus, wherein one TV field is composed of a plurality of subfields which have different luminance weightings and are arranged in order of time, for displaying an image of the TV field in a multi-level gray scale by selecting, for each pixel, an "on"/"off" subfield combination in which subfields that are "on" and subfields that are "off" are selected from the plurality of subfields, comprising:

conversion means for converting an input image signal into "on"/"off" information of the plurality of subfields for each pixel;

a display, in which each pixel on a screen is composed of at least one luminous cell; and display control means for dividing the "on"/"off" information of the plurality of subfields composing the TV field which has been produced by the conversion means into "on"/"off" information of each subfield, and for turning "on"/"off" each luminous cell of the display according to the "on"/"off" information of each subfield in any of an ascending order and a descending order of the luminance weightings of the plurality of subfields, wherein the conversion means stores "on"/"off" information of the plurality of subfields which corresponds to each input image signal level, wherein the luminance weightings of the plurality of subfields are determined so that luminance weightings of subfields which are in a first subfield group with luminance weightings smaller than a predetermined luminance weighting form a geometric series, and luminance weightings of subfields, other than the subfields in the first group, which are in a second subfield group form a substantially arithmetic series, and wherein the plurality of subfields are arranged in any of a substantially increasing order and a substantially decreasing order of the luminance weightings.

19. The image display apparatus of claim 18, wherein the conversion means includes a table showing a correspondence between each input image signal level and the "on"/"off" information of the plurality of subfields.

20. The image display apparatus of claim 19, wherein an "on"/"off" subfield combination, out of a plurality of possible "on"/"off" subfield combinations for displaying a gray level, in which subfields with large luminance weightings are "off" is given in the table as the "on"/"off" information of the plurality of subfields for displaying the gray level.

21. The image display apparatus of claim 20, wherein one of the following arrangements is used when a total number of gray levels is 256;

(1) the plurality of subfields are composed of nine subfields with a luminance weighting ratio of 1:2:4:8:16:32:48:64:80;

(2) the plurality of subfields are composed of ten subfields with the luminance weighting ratio of 1:2:4:8:16:24:32:48:56:64;

(3) the plurality of subfields are composed of eleven subfields with the luminance weighting ratio of 1:2:4:8:16:24:32:36:40:44:40;

(4) the plurality of subfields are composed of twelve subfields with the luminance weighting ratio of 1:2:4:8:12:20:24:28:32:36:40:48; and (5) the plurality of subfields are composed of twelve subfields with the luminance weighting ratio of 1:2:4:8:12:16:24:28:32:36:44:48.

22. The image display apparatus of claim 19, wherein an "on"/"off" subfield combination, out of possible "on"/"off" subfield combinations for displaying a present gray level which is one level higher than a gray level which was displayed immediately before the present gray level, in which a subfield adjacent to a subfield with a largest weighting that is turned "on" becomes "off" is given priority for displaying the present gray level in the table.

23. The image display apparatus of claim 18, further comprising image signal alteration means which receives the image signal one of before and after the conversion means, the image signal alteration means for altering, when a gray level of the input image signal corresponding to a present pixel is within a predetermined range, each gray level of adjacent pixels including the present pixel alternately into a higher level and a lower level.

24. The image display apparatus of claim 23, further comprising moving/static image judgement means for judging whether the present pixel of the input image signal constitutes one of a moving image and a static image, wherein the image signal alteration means is activated when the moving/static image judgement means judges that the present pixel of the input image signal constitutes the moving image.

25. The image display apparatus of claim 24, wherein the image signal alteration means comprises:

a first conversion unit for converting the gray level of the input image signal to a higher level;

a second conversion unit for converting the gray level of the input image signal to a lower level; and a selection unit for alternately selecting the first conversion unit and the second conversion unit in synchronization with a pixel clock.

26. The image display apparatus of claim 25, wherein the first conversion unit and the second conversion unit include a conversion table in which each gray level of an input image signal is associated with a higher level and a lower level into which each gray level of the input image signal is to be converted.

27. The image display apparatus of claim 26, wherein gray levels converted by the first conversion unit and the second conversion unit are within a predetermined range of grey levels centered on a certain gray level, the certain gray level being a gray level where "on"/"off" information of the plurality of subfields, produced by the conversion means converting an input image signal, is such that a subfield adjacent to a subfield with a highest luminance weighting out of subfields that are "on" is "off", the first conversion unit and the second conversion unit converting the grey levels within the predetermined range into grey levels whose "on"/"off" information of the plurality of subfields is such that a subfield with a highest luminance weighting out of subfields that are "on" and a subfield with a next highest luminance weighting are both "on".

28. The image display apparatus of claim 18, further comprising image signal alteration means which receives the image signal one of before and after the conversion means, the image signal alteration means for altering, when a gray level of the input image signal corresponding to one pixel is within a predetermined range, each gray level of the pixel corresponding to two successive frames alternately into a higher level and a lower level.

29. The image display apparatus of claim 28, further comprising moving/static image judgement means for judging whether the pixel of the input image signal constitutes one of a moving image and a static image, wherein the image signal alteration means is activated when the moving/static image judgement means judges that the pixel of the input image signal constitutes the moving image.

30. The image display apparatus of claim 29, wherein the image signal alteration means comprises:

a first conversion unit for converting the gray level of the input image signal to a higher level;

a second conversion unit for converting the gray level of the input image signal to a lower level; and a selection unit for alternately selecting the first conversion unit and the second conversion unit in synchronization with a pixel clock.

31. The image display apparatus of claim 30, wherein the first conversion unit and the second conversion unit include a conversion table in which each gray level of an input image signal is associated with a higher level and a lower level into which each gray level of the input image signal is to be converted.

32. The image display apparatus of claim 31, wherein gray levels converted by the first conversion unit and the second conversion unit are within a predetermined range of grey levels centered on a certain gray level, the certain gray level being a gray level where "on"/"off" information of the plurality of subfields, produced by the conversion means converting an input image signal, is such that a subfield adjacent to a subfield with a highest luminance weighting out of subfields that are "on" is "off", the first conversion unit and the second conversion unit converting the grey levels within the predetermined range into grey levels whose "on"/"off" information of the plurality of subfields is such that a subfield with a highest luminance weighting out of subfields that are "on" and a subfield with a next highest luminance weighting are both "on".

* * * * *